US011515621B2

(12) United States Patent
Ramasamy et al.

(10) Patent No.: US 11,515,621 B2
(45) Date of Patent: Nov. 29, 2022

(54) SYSTEM AND METHOD FOR OPERATING AN ANTENNA WITHIN AN ANTENNA VENT BEING CO-LOCATED WITH AN AUDIO OR THERMAL VENT

(71) Applicant: Dell Products, LP, Round Rock, TX (US)

(72) Inventors: Suresh K. Ramasamy, Cedar Park, TX (US); Sumana Pallampati, Austin, TX (US); Changsoo Kim, Cedar Park, TX (US)

(73) Assignee: Dell Products, LP, Round Rock, TX (US)

( * ) Notice: Subject to any disclaimer, the term of this patent is extended or adjusted under 35 U.S.C. 154(b) by 148 days.

(21) Appl. No.: 16/705,129

(22) Filed: Dec. 5, 2019

(65) Prior Publication Data

US 2021/0175610 A1 Jun. 10, 2021

(51) Int. Cl.

| | |
|---|---|
| ***H01Q 1/24*** | (2006.01) |
| ***H01Q 1/22*** | (2006.01) |
| ***H01Q 9/30*** | (2006.01) |

(52) U.S. Cl.

CPC ..... *H01Q 1/243* (2013.01); *H01Q 1/2266* (2013.01); *H01Q 9/30* (2013.01)

(58) Field of Classification Search

CPC ..... H01Q 1/243; H01Q 1/2266; H01Q 9/30

See application file for complete search history.

(56) References Cited

U.S. PATENT DOCUMENTS

| | | | | |
|---|---|---|---|---|
| 6,392,605 | B2 * | 5/2002 | Anterow | H01Q 5/371 343/702 |
| 6,414,643 | B2 * | 7/2002 | Cheng | G06F 1/1616 343/702 |
| 6,509,877 | B2 * | 1/2003 | Masaki | H01Q 1/2266 343/702 |
| 6,636,181 | B2 * | 10/2003 | Asano | H01Q 21/28 343/702 |
| 6,654,231 | B2 * | 11/2003 | Teshima | H01Q 1/2266 361/730 |
| 6,667,719 | B2 * | 12/2003 | LaKomski | H01Q 1/38 343/702 |
| 6,724,348 | B2 * | 4/2004 | Fang | G06F 1/1698 343/702 |
| 6,879,293 | B2 * | 4/2005 | Sato | H01Q 13/10 343/702 |
| 7,068,229 | B2 * | 6/2006 | Lin | H01Q 1/38 343/702 |

(Continued)

*Primary Examiner* — Dimary S Lopez Cruz
*Assistant Examiner* — Bamidele A Jegede
(74) *Attorney, Agent, or Firm* — Prol Intellectual Property Law, PLLC; H. Kenneth Prol

(57) ABSTRACT

An information handling system to wirelessly transmit and receive data at an antenna may include a base housing metal chassis containing components of the information handling system including a thermal vent, an audio vent, and an antenna vent, the antenna vent being co-located with the thermal vent and audio vent; and the co-located antenna vent including: partitions defining a width of an aperture formed at the co-located antenna vent to accommodate a target frequency range; a monopole antenna system formed within the co-located antenna vent including a parasitic coupling element; and a grounding wall defined along an edge of the co-located antenna vent.

20 Claims, 8 Drawing Sheets

(56) References Cited

U.S. PATENT DOCUMENTS 8,059,039 B2 * 11/2011 Ayala Vazquez .... H01Q 1/2266 343/702
8,059,040 B2 * 11/2011 Ayala Vazquez ..... H01Q 1/02 343/702
8,125,394 B2 * 2/2012 Chiang ..... H01Q 1/2266 343/702
8,228,239 B2 * 7/2012 Lagnado ..... H01Q 9/42 343/702
2006/0244663 A1 * 11/2006 Fleck ..... G06F 1/1698 343/702
2007/0176831 A1 * 8/2007 Lagnado ..... G06F 1/1698 343/702
2010/0073241 A1 * 3/2010 Ayala Vazquez .... H01Q 1/2266 343/702
2010/0134361 A1 * 6/2010 Nakano ..... H01Q 1/2275 343/702
2010/0231481 A1 * 9/2010 Chiang ..... H01Q 9/42 343/702
2012/0068893 A1 * 3/2012 Guterman ..... H01Q 1/2266 343/702
2012/0074988 A1 * 3/2012 Lashkari ..... H04L 25/0264 327/109
2012/0241140 A1 * 9/2012 MacDonald ..... G06F 1/206 165/278
2014/0111388 A1 * 4/2014 Di Nallo ..... H01Q 5/378 343/702
2014/0184451 A1 * 7/2014 Kuo ..... H01Q 1/243 343/702
2015/0244059 A1 * 8/2015 Onaka ..... H01Q 21/28 343/702
2016/0294067 A1 * 10/2016 Chang ..... H01Q 5/364
2017/0207542 A1 * 7/2017 Tseng ..... H01Q 13/106
2017/0212554 A1 * 7/2017 Guterman ..... G06F 1/1681
2017/0302771 A1 * 10/2017 Kim ..... H01Q 1/243
2018/0040942 A1 * 2/2018 Lepe ..... H01Q 1/2266
2019/0036223 A1 * 1/2019 Wu ..... G06F 1/1698
2019/0237848 A1 * 8/2019 Ramasamy ..... G06F 1/1683
2019/0237865 A1 * 8/2019 Ramasamy ..... H01Q 1/523
2019/0356051 A1 * 11/2019 Barrera ..... H01Q 21/28

* cited by examiner

SYSTEM AND METHOD FOR OPERATING AN ANTENNA WITHIN AN ANTENNA VENT BEING CO-LOCATED WITH AN AUDIO OR THERMAL VENT

FIELD OF THE DISCLOSURE

The present disclosure generally relates to information handling systems, and more particularly relates to an information handling system including an antenna within an antenna vent co-located along with a thermal and an audio vent formed within a chassis of the information handling system.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, read-only memory (ROM), and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components. The information handling system may also include telecommunication, network communication, and video communication capabilities. The information handling system may also include one or more buses operable to transmit communications between the various hardware components. The information handling system may also include telecommunication, network communication, and video communication capabilities. Information handling system chassis parts may include case portions such as for a laptop information handling system including the C-cover over components designed with a metal structure. The information handling system may be configurable such that the information handling system may operate in any of several usage mode configurations.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

Figure 1:
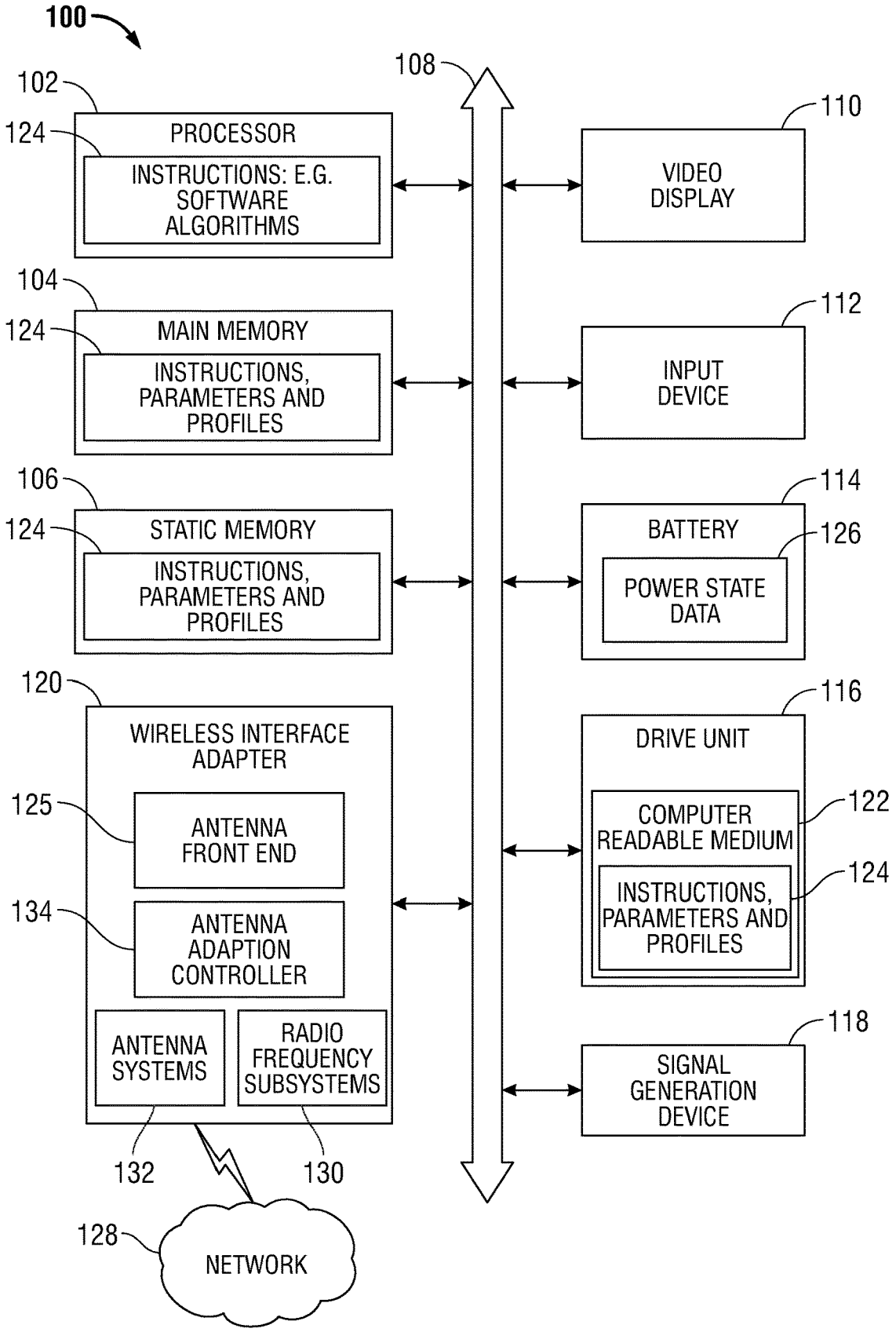
FIG. 1 is a block diagram of an embodiment of information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

For aesthetic, strength, and performance reasons, information handling system chassis parts are more commonly designed with a metal structure. In an example embodiment, a laptop information handling system may include a plurality of covers for the interior components of the information handling system. For example, a small form factor case may include an A-cover which serves as a back cover for a display housing and a B-cover which may serve as the bezel, if any, and a display screen of the convertible laptop information handling system in an embodiment. In a further example, the laptop information handling system case may include a C-cover housing a keyboard, touchpad, and any cover in which these components are set and a D-cover forming a base housing for the convertible information handling system. With the need for utility of lighter, thinner, and more streamlined devices, the use of full metal portions for the outer covers of the display and base housing (e.g. the A-cover and the D-cover) is desirable for strength as well as aesthetic reasons. At the same time, the demands for wireless operation also increase. This includes addition of many simultaneously operating radiofrequency systems, addition of more antennas, and utilization of various antenna types. However, the thinner and more streamlined devices have fewer locations and area available for mounting radiofrequency transmitters on these mobile information handling systems. Thus, a streamlined, full metal chassis capable of meeting the increasing wireless operation demands is needed.

Previous information handling systems would address these competing needs by providing for cutout portions of a metal outer chassis cover filled with plastic behind which radio transmitters would be mounted. The cutouts to accommodate radio frequency (RF) transmitters were often located in aesthetically undesirable locations or required additional plastic components to cover the cutout, thus not fully meeting the streamlining needs. The plastic components added a component to be manufactured and were required to be seamlessly integrated into an otherwise smooth metal chassis cover. Further, the plastic portions included may be more expensive to machine than aluminum alloy metals, and may require intricate multi-step processes for integrating the metal and plastic parts into a single chassis. This requirement could require difficult and expensive processes to manufacture with a less desirable result. Other options included, for aperture type antenna transmitters, creation of an aperture in the metal display panel chassis and using the metal chassis as a ground plane for excitation of the aperture. Similarly, the visible apertures in the chassis cover were also less desirable, and the radio frequency (RF) transmission hotspot would be located on the metal chassis cover itself.

In addition, in the case of the convertible laptop information handling system, 360-degree configurability may be a feature available to a user during use. Thus, often an antenna such as an aperture antenna system would be located at the top (e.g. A-cover) with a plastic antenna window in a metal chassis cover to radiate in 360-degree mode (such as closed mode), or at the base (e.g. between the C and D-cover) to radiate in 360-degree mode (such as open mode). Such a configuration could make the display panel housing or the base panel housing thicker, to accommodate antennas and cables behind the plastic panel at the top (or bottom) of either housing. Overall, an additional of a plastic antenna window in an A-cover or C-cover may not meet the streamlining needs. A solution is needed that does not increase the thickness of the metal chassis, and does not require additional components and manufacturing steps such as those associated with installation of RF transparent windows.

Embodiments of the present disclosure may decrease the complexity and cost of creating chasses for information handling systems by forming the outer chassis (e.g. the A-cover or the D-cover) entirely of metal and co-locating an antenna vent with an audio vent and/or a thermal vent. This placement of the antenna vent into a location along with either or both of the audio vent and thermal vent allows the antenna to be placed within the antenna vent at a location that provides for a relatively more streamlined information handling system as described herein. Additionally, regardless of the orientation of the information handling system, the antenna receipt and transmission strength may remain constant. Still further, the antenna vent may include one or more grounding walls thereby creating a resonant chamber with an aperture that directs antenna-emitted electromagnetic radiation out of the antenna vent without any noise being created due to the metallic chassis of the information handling systems as described herein.

The metal chassis in embodiments described herein may include a hinge operably connecting the A-cover to the D-cover such that the keyboard and touchpad enclosed within the C-cover and attached to the D-cover may be placed in a plurality of configurations with respect to the digital display enclosed within the B-cover and attached to the A-cover. The plurality of configurations may include, but may not be limited to, an open configuration in which the A-cover is oriented at a right or obtuse angle from the D-cover (similar to an open laptop computer), a closed configuration in which the A-cover lies substantially parallel to the D-cover (similar to a closed laptop computer), and a tablet configuration in which the A-cover is rotated nearly 360 degrees from its closed orientation (placing the D-cover directly beneath the A-cover, such that the user can interact with the digital display enclosed within the B-cover and A-cover of the display housing) or other orientations such as an easel orientation. Despite these different configurations, however, the antenna vent co-located with one or both of the audio vent and thermal vent provides for the streamlining of the information handling system without compromising the ability of the antenna to transmit and receive data from and to the information handling system.

Manufacture of embodiments of the present disclosure may involve fewer extraneous parts than previous chasses by forming the exterior or outer portions of the information handling system, including the bottom portion of the D-cover and the top portion of the A-cover, entirely from metal. In order to allow for manufacture of fully metallic outer chasses including the A-cover and the D-cover, embodiments of the present disclosure form the full form factor case enclosing the information handling system such that one or more transmitting antennas within the antenna vent integrated into the base metal chassis (i.e., D-cover) of the information handling system.

The transmitting antennas of embodiments of the present disclosure may include aperture antennas. Aperture antennas in embodiments of the present disclosure may be a highly effective improvement on wireless antennas employed in previous information handling systems. In embodiments of the present disclosure, an antenna aperture or slot may be co-located with an audio and/or thermal vent with one or more partitions separating the antenna vent from the audio and/or thermal vents. An aperture associated with the antenna in embodiments of the present disclosure may be formed in the sidewall of the information handling system base chassis, such as in a sidewall of the D-cover. An isolation cavity may be defined by a number of grounding walls formed within the antenna vent in some embodiments to prevent cavity modes in the system. In an embodiment, the antenna aperture may house a monopole antenna in the cavity radiating at 5 GHz. The antenna aperture is capacitively excited from the monopole antenna located inside the antenna vent and aperture. In this embodiment, the grounding walls may prevent resonant cavity modes to be propagated elsewhere in the remainder of the information handling system. Such a method of placing an aperture associated with the antenna at a location with the audio vent and/or thermal vent of the form factor case may exclude the integration of any RF transparent plastic windows within the exterior of the A-cover or of the D-cover, thus decreasing the complexity and cost of manufacture. In other embodiments, a plastic or other RF-transmission window cover may be used at the vent location if some type of water resistance is needed, for example. The antenna may then effectively transmit communications signal perpendicularly from the surface of the D-cover. When the D-cover and A-cover are placed in either the open configuration, or the tablet configuration, the antenna in such an embodiment may transmit the communications signals away from the information handling system and into the nearby environment. When the D-cover and A-cover are placed in the closed configuration, the antenna may transmit and receive the communications signal out from the D-cover still allowing for transmission and receipt of data via the antenna.

Embodiments of the present disclosure may also allow the antenna to operate at higher power levels in the presence of human body parts than previous information handling systems with antennas located in the base housing chassis or D-cover. The Federal Communications Commission (FCC) regulates the strength of RF signals of an LTE, wireless local area network (WLAN), or wireless wide area network (WWAN) antenna or other antenna systems within a commercial product sold in the United States may emit. Higher strength RF signals may result in stronger signals and better communication, but may also increase the specific absorption rate (SAR), or rate at which energy is absorbed by the human body. For example, the FCC requires WiFi or LTE antennas within US commercial products to lower the power supplied to the WiFi or LTE antenna when the antenna is in close proximity to a human body part in order to avoid any increase in SAR. In order to comply with these requirements, many WiFi or LTE-compatible devices include proximity sensors that may detect nearby human body parts. The requirement of power reduction depends on hotspot radiofrequency SAR levels detected around the information handling system where a user may come into contact. Power reduction however may also have an adverse effect on radiofrequency system performance. SAR levels drop off significantly however with distance from an active transmitter. Thus, an antenna transmitter location and design where the active transmission element may be located further away from any surfaces potentially contacted by a user's body parts may not require as much power reduction.

In embodiments described herein, the D-cover antenna aperture platform may lie vertically lower than the keyboard of the C-cover, which is a surface that interfaces with human body parts along with the D-cover. In such embodiments, placement of the transmitting antenna beneath the C-cover along a vent of the D-cover may place the antenna further away from human body parts than an information handling system placing the transmitting antenna directly beneath, beside, or co-planar with the keyboard. This is especially true, for example, if the convertible information handling system is resting on a desk or table. In other aspects, the D-cover may further include, an antenna vent placed between the D-cover and the keyboard/keypad portion of the C-cover, creating a dual vent, connected by a vertical grounding wall placed between the vents, and forming a resonant cavity that re-radiates any EM fields therein, above, and below the device through the dual vents. The resonant cavity in embodiments may spread the surface currents more evenly within the antenna vent than an embodiment in which the resonant cavity formed by the wall is not included. Such even distribution of RF radiation within the antenna vent may decrease the radiation emitted at any one point across the aperture. As a result, the SAR of the evenly distributed signal transmitted via both the antenna aperture and antenna vent may be lower at each location within the antenna vent than the SAR of a signal transmitted with the same power via only the antenna aperture. Thus, smaller reductions in power supplied to the transmitter may be required in order to comply with FCC regulations in such embodiments. Further, by placing this gap between the C-cover upon which a human body part may rest, and the D-cover, within which the transceiving antenna may be incorporated, embodiments of the present disclosure may locate the antenna transceiver further away from the C-cover or D-cover in contact with a user's body parts, and may not require as much power reduction. In certain embodiments, the antenna vent described herein may also cause any EM RF transmissions from the monopole antenna to re-radiate towards the C-cover or out of a side antenna vent thereby distributing any or all SAR hotspots away from a bottom surface of the D-cover where the information handling system may interact with a user's legs, for example. Such re-radiation of EM RF transmissions to the C-cover or out of a base chassis side wall may reduce the SAR at the lap of a user thereby reducing hotspots or concentration of EM RF transmissions at the bottom of the base chassis D-cover of the information handling system.

Still further, the antenna vent described herein may include one or more grounding walls. The grounding walls may be used to facilitate the resonant functionalities described herein. Specifically, the grounding walls may form the antenna vent into a resonant chamber used to direct antenna-emitted electromagnetic radiation out of the antenna vent via the aperture while reducing noise that might be created due to the metallic chassis of the information handling systems as described herein. In an embodiment, avoidance of EM RF energy propagating into the chassis of the information handling system behind the grounding walls may avoid RF noise that may be caused by or pollutes the performance of the transceiver circuitry or other circuitry located within the base chassis behind the grounding walls forming the antenna cavity. In these embodiments described herein, the grounding walls act as a resonant chamber and an isolation barrier to contain and direct the EM RF fields via the antenna cavity chamber.

Examples are set forth below with respect to particular aspects of an information handling system including case portions such as for a laptop information handling system including the chassis components designed with a fully metal structure and configurable such that the information handling system may operate in any of several usage mode configurations.

FIG. 1 is a block diagram of an information handling system 100 capable of administering each of the specific embodiments of the present disclosure. The information handling system 100, in an embodiment, can represent the mobile information handling systems 210, 220, and 230 or servers or systems located anywhere within network 200 described in connection with FIG. 2 herein, including the remote data centers operating virtual machine applications. Information handling system 100 may represent a mobile information handling system associated with a user or recipient of intended wireless communication. A mobile information handling system may execute instructions via a processor such as a microcontroller unit (MCU) operating both firmware instructions or hardwired instructions for the antenna adaptation controller 134 to achieve WLAN or WWAN antenna optimization according to embodiments disclosed herein. The application programs operating on the information handling system 100 may communicate or otherwise operate via concurrent wireless links, individual wireless links, or combinations over any available radio access technology (RAT) protocols including WLAN protocols. These application programs may operate in some example embodiments as software, in whole or in part, on an information handling system while other portions of the software applications may operate on remote server systems. An antenna adaptation controller 134 of the presently disclosed embodiments may operate as firmware or hardwired circuitry or any combination on controllers or processors within the information handing system 100 for interface with components of a wireless interface adapter 120. It is understood that some aspects of the antenna adaptation controller 134 described herein may interface or operate as software or via other controllers associated with the wireless interface adapter 120 or elsewhere within information handling system 100. Information handling system 100 may also represent a networked server or other system from which some software applications are administered or which wireless communications such as across WLAN or WWAN may be conducted. In other aspects, networked servers or systems may operate the antenna adaptation controller 134 for use with a wireless interface adapter 120 on those devices similar to embodiments for WLAN or WWAN antenna optimization operation according to according to various embodiments.

The information handling system 100 may include a processor 102 such as a central processing unit (CPU), a graphics processing unit (GPU), or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, a solid-state display, or a cathode ray tube (CRT). Display 110 may include a touch screen display module and touch screen controller (not shown) for receiving user inputs to the information handling system 100. Touch screen display module may detect touch or proximity to a display screen by detecting capacitance changes in the display screen as understood by those of skill. Additionally, the information handling system 100 may include an input device 112, such as a keyboard, and a cursor control device, such as a mouse or touchpad or similar peripheral input device. The information handling system may include a power source such as battery 114 or an A/C power source. The information handling system 100 can also include a disk drive unit 116, and a signal generation device 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a 360-degree convertible device, a wearable computing device, or a mobile smart phone.

The information handling system 100 can include sets of instructions 124 that can be executed to cause the computer system to perform any one or more desired applications. In many aspects, sets of instructions 124 may implement wireless communications via one or more antenna systems 132 available on information handling system 100. Operation of WLAN and WWAN wireless communications may be enhanced or otherwise improved via WLAN or WWAN antenna operation adjustments via the methods or controller-based functions relating to the antenna adaptation controller 134 disclosed herein. For example, instructions or a controller may execute software or firmware applications or algorithms which utilize one or more wireless signal parameters via the wireless adapter interface for wireless communications via the wireless interface adapter as well as other aspects or components. The antenna adaptation controller 134 may execute instructions as disclosed herein for monitoring wireless link state information, information handling system configuration data, SAR proximity sensor detection, or other input data to generate channel estimation and determine antenna radiation patterns. In the embodiments presented herein, the antenna adaptation controller 134 may execute instructions as disclosed herein to transmit a communications signal from an antenna located within an antenna vent, creating a resonant frequency at an aperture of the antenna vent to transmit an electromagnetic wave at a determined frequency or harmonics thereof, and preventing noise sourced outside the antenna vent from creating interference with the determined frequency, or harmonics thereof, and reflecting transmission or receiving power for the antenna system via an isolation wall within the antenna vent. In the embodiments presented herein, the antenna adaptation controller 134 may execute instructions as disclosed herein to adjust, via a parasitic coupling element, change the directionality and/or pattern of the emitted RF signals from the antenna. The antenna adaptation controller 134 may implement adjustments to wireless antenna systems and resources via a radio frequency integrated circuit (RFIC) front end 125 and WLAN or WWAN radio module systems within the wireless interface device 120. Aspects of the antenna optimization for the antenna adaptation controller 134 may be included as part of an antenna front end 125 in some aspects or may be included with other aspects of the wireless interface device 120 such as WLAN radio module such as part of the RF subsystems 130. The antenna adaptation controller 134 described in the present disclosure and operating as firmware or hardware (or in some parts software) may remedy or adjust one or more of a plurality of antenna systems 132 via selecting power adjustments and adjustments to an antenna adaptation network to modify antenna radiation patterns and parasitic coupling element operations. Multiple WLAN or WWAN antenna systems may operate on various communication frequency bands such as under IEEE 802.11a and IEEE 802.11g providing multiple band options for frequency channels. Further antenna radiation patterns and selection of antenna options or power levels may be adapted due physical proximity of other antenna systems, of a user with potential SAR exposure, or improvement of RF channel operation according to received signal strength indicator (RSSI), signal to noise ratio (SNR), bit error rate (BER), modulation and coding scheme index values (MCS), or data throughput indications among other factors. In some aspects WLAN antenna adaptation controller may execute firmware algorithms or hardware to regulate operation of the one or more antenna systems 132 such as WLAN antennas in the information handling system 100 to avoid poor wireless link performance due to poor reception, poor MCS levels of data bandwidth available, or poor indication of throughput due to indications of low RSSI, low power levels available (such as due to SAR), inefficient radiation patterns among other potential effects on wireless link channels used.

Various software modules comprising software application instructions 124 or firmware instructions may be coordinated by an operating system (OS) and via an application programming interface (API). An example operating system may include Windows®, Android®, and other OS types known in the art. Example APIs may include Win 32, Core Java API, Android APIs, or wireless adapter driver API. In a further example, processor 102 may conduct processing of mobile information handling system applications by the information handling system 100 according to the systems and methods disclosed herein which may utilize wireless communications. The computer system 100 may operate as a standalone device or may be connected such as using a network, to other computer systems or peripheral devices. In other aspects, additional processor or control logic may be implemented in graphical processor units (GPUs) or controllers located with radio modules or within a wireless adapter 120 to implement method embodiments of the antenna adaptation controller and antenna optimization according to embodiments herein. Code instructions 124 in firmware, hardware or some combination may be executed to implement operations of the antenna adaptation controller and antenna optimization on control logic or processor systems within the wireless adapter 120 for example.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a PDA, a mobile information handling system, a tablet computer, a laptop computer, a desktop computer, a communications device, a wireless smart phone, wearable computing devices, a land-line telephone, a control system, a camera, a scanner, a printer, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions, parameters, or profiles 124. The disk drive unit 116 and static memory 106 also contains space for data storage. Some memory or storage may reside in the wireless adapter 120. Further, the instructions 124 that embody one or more of the methods or logic as described herein. For example, instructions relating to the WLAN antenna adaptation system or antenna adjustments described in embodiments herein may be stored here or transmitted to local memory located with the antenna adaptation controller 134, antenna front end 125, or wireless module in radiofrequency subsystem 130 in the wireless interface adapter 120.

In a particular embodiment, the instructions, parameters, and profiles 124 may reside completely, or at least partially, within a memory, such as non-volatile static memory, during execution of antenna adaptation by the antenna adaptation controller 134 in wireless interface adapter 132 of information handling system 100. As explained, some or all of the WLAN antenna adaptation and antenna optimization may be executed locally at the antenna adaptation controller 134, RF front end 125, or wireless module subsystem 130. Some aspects may operate remotely among those portions of the wireless interface adapter or with the main memory 104 and the processor 102 in parts including the computer-readable media in some embodiments.

Battery 114 may be operatively coupled to a power management unit that tracks and provides power state data 126. This power state data 126 may be stored with the instructions, parameters, and profiles 124 to be used with the systems and methods disclosed herein in determining WLAN antenna adaptation and antenna optimization in some embodiments.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more RF subsystems 130 with transmitter/receiver circuitry, modem circuitry, one or more unified antenna front end circuits 125, one or more wireless controller circuits such as antenna adaptation controller 134, amplifiers, antenna systems 132 and other RF subsystem circuitry 130 for wireless communications via multiple radio access technologies. Each radiofrequency subsystem 130 may communicate with one or more wireless technology protocols. The radiofrequency subsystem 130 may contain individual subscriber identity module (SIM) profiles for each technology service provider and their available protocols for subscriber-based radio access technologies such as cellular LTE communications. The wireless adapter 120 may also include antenna systems 132 which may be tunable antenna systems or may include an antenna adaptation network for use with the system and methods disclosed herein to optimize antenna system operation. Additional antenna system adaptation network circuitry (not shown) may also be included with the wireless interface adapter 120 to implement WLAN or WWAN modification measures as described in various embodiments of the present disclosure.

In some aspects of the present disclosure, a wireless adapter 120 may operate two or more wireless links. In a further aspect, the wireless adapter 120 may operate the two or more wireless links with a single, shared communication frequency band such as with the Wi-Fi WLAN operation or 5G LTE standard WWAN operations in an example aspect. For example, a 5 GHz wireless communication frequency band may be apportioned under the 5G standards for communication on either small cell WWAN wireless link operation or Wi-Fi WLAN operation as well as other wireless activity in LTE, WiFi, WiGig, Bluetooth, or other communication protocols. In some embodiments, the shared, wireless communication bands may be transmitted through one or a plurality of antennas. Other communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands. The plurality of wireless adapters 120 may further operate in nearby wireless communication bands in some disclosed embodiments. Further, harmonics, environmental wireless conditions, and other effects may impact wireless link operation when a plurality of wireless links are operating as in some of the presently described embodiments. The series of potential effects on wireless link operation may cause an assessment of the wireless adapters 120 to potentially make antenna system adjustments according to the WLAN antenna adaptation control system of the present disclosure.

The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. Wireless adapter 120 and antenna adaptation controller 134 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN carriers which may operate in both licensed and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). It is understood that any number of available channels may be available under the 5 GHz shared communication frequency band in example embodiments. WLAN, for example, may also operate at a 2.4 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless RF communication capabilities as well as licensed wireless RF communication capabilities. For example, licensed wireless RF communication capabilities may be available via a subscriber carrier wireless service. With the licensed wireless RF communication capability, WWAN RF front end may operate on a licensed WWAN wireless radio with authorization for subscriber access to a wireless service provider on a carrier licensed frequency band.

The wireless adapter 120 can represent an add-in card, wireless network interface module that is integrated with a main board of the information handling system or integrated with another wireless network interface capability, or any combination thereof. In an embodiment the wireless adapter 120 may include one or more RF subsystems 130 including transmitters and wireless controllers such as wireless module subsystems for connecting via a multitude of wireless links under a variety of protocols. In an example embodiment, an information handling system may have an antenna system transmitter 132 for 5G small cell WWAN, Wi-Fi WLAN or WiGig connectivity and one or more additional antenna system transmitters 132 for macro-cellular communication. The RF subsystems 130 include wireless controllers to manage authentication, connectivity, communications, power levels for transmission, buffering, error correction, baseband processing, and other functions of the wireless adapter 120.

The RF subsystems 130 of the wireless adapters may also measure various metrics relating to wireless communication pursuant to operation of an antenna system as in the present disclosure. For example, the wireless controller of a RF subsystem 130 may manage detecting and measuring received signal strength levels, bit error rates, signal to noise ratios, latencies, power delay profile, delay spread, and other metrics relating to signal quality and strength. Such detected and measured aspects of wireless links, such as WLAN links operating on one or more antenna systems 132, may be used by the antenna adaptation controller to adapt the antenna systems 132 according to an antenna adaptation network by various embodiments herein. In one embodiment, a wireless controller of a wireless interface adapter 120 may manage one or more RF subsystems 130. The wireless controller also manages transmission power levels which directly affect RF subsystem power consumption as well as transmission power levels from the plurality of antenna systems 132. The transmission power levels from the antenna systems 132 may be relevant to specific absorption rate (SAR) safety limitations for transmitting mobile information handling systems. To control and measure power consumption via a RF subsystem 130, the RF subsystem 130 may control and measure current and voltage power that is directed to operate one or more antenna systems 132.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionalities as described herein.

The present disclosure contemplates a computer-readable medium that includes instructions, parameters, and profiles 124 or receives and executes instructions, parameters, and profiles 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs 124, and Basic Input/Output System and firmware (BIOS/FW) code 124. BIOS/FW code 124 functions to initialize information handling system 100 on power up, to launch an operating system, and to manage input and output interactions between the operating system and the other elements of information handling system 100. In a particular embodiment, BIOS/FW code 124 reside in memory 104, and include machine-executable code that is executed by processor 102 to perform various functions of information handling system 100. In another embodiment (not illustrated), application programs and BIOS/FW code reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in storage system 107, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2:
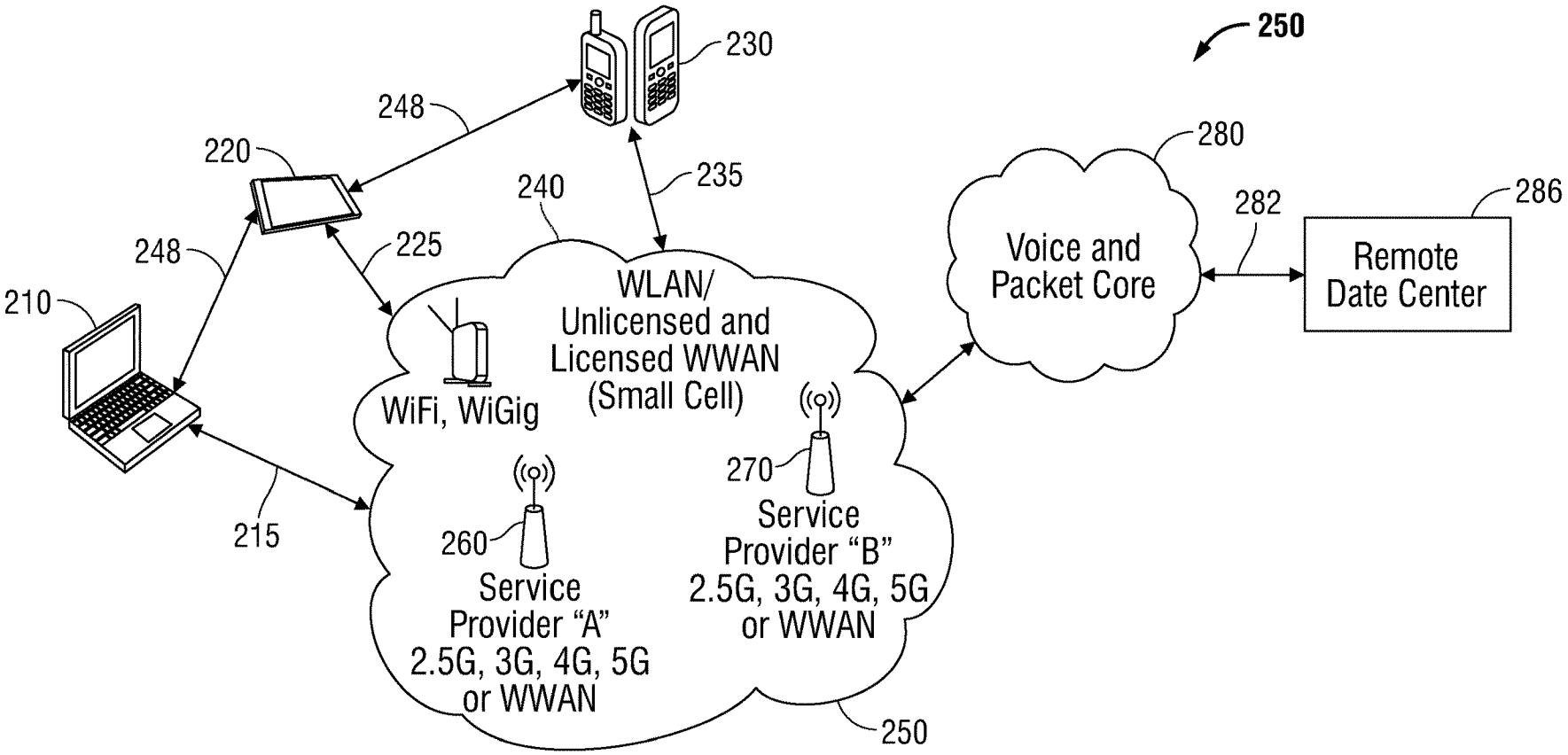
FIG. 2 is a block diagram of a network environment offering several communication protocol options and mobile information handling systems according to an embodiment of the present disclosure.

FIG. 2 illustrates a network 200 that can include one or more information handling systems 210, 220, 230. In a particular embodiment, network 200 includes networked mobile information handling systems 210, 220, and 230, wireless network access points, and multiple wireless connection link options. A variety of additional computing resources of network 200 may include client mobile information handling systems, data processing servers, network storage devices, local and wide area networks, or other resources as needed or desired. As partially depicted, systems 210, 220, and 230 may be a laptop computer, tablet computer, 360-degree convertible systems, wearable computing devices, or a smart phone device. These mobile information handling systems 210, 220, and 230, may access a wireless local network 240, or they may access a macro-cellular network 250. For example, the wireless local network 240 may be the wireless local area network (WLAN), a wireless personal area network (WPAN), or a wireless wide area network (WWAN). In an example embodiment, LTE-LAA WWAN may operate with a small-cell WWAN wireless access point option.

Since WPAN or Wi-Fi Direct Connection 248 and WWAN networks can functionally operate similar to WLANs, they may be considered as wireless local area networks (WLANs) for purposes herein. Components of a WLAN may be connected by wireline or Ethernet connections to a wider external network. For example, wireless network access points may be connected to a wireless network controller and an Ethernet switch. Wireless communications across wireless local network 240 may be via standard protocols such as IEEE 802.11 Wi-Fi, IEEE 802.11ad WiGig, IEEE 802.15 WPAN, or emerging 5G small cell WWAN communications such as eNodeB, or similar wireless network protocols. Alternatively, other available wireless links within network 200 may include macro-cellular connections 250 via one or more service providers 260 and 270. Service provider macro-cellular connections may include 2G standards such as GSM, 2.5G standards such as GSM EDGE and GPRS, 3G standards such as W-CDMA/UMTS and CDMA 2000, 4G standards, or emerging 5G standards including WiMAX, LTE, and LTE Advanced, LTE-LAA, small cell WWAN, and the like.

Wireless local network 240 and macro-cellular network 250 may include a variety of licensed, unlicensed or shared communication frequency bands as well as a variety of wireless protocol technologies ranging from those operating in macrocells, small cells, picocells, or femtocells.

In some embodiments according to the present disclosure, a networked mobile information handling system 210, 220, or 230 may have a plurality of wireless network interface systems capable of transmitting simultaneously within a shared communication frequency band. That communication within a shared communication frequency band may be sourced from different protocols on parallel wireless network interface systems or from a single wireless network interface system capable of transmitting and receiving from multiple protocols. Similarly, a single antenna or plural antennas may be used on each of the wireless communication devices. Example competing protocols may be local wireless network access protocols such as Wi-Fi/WLAN, WiGig, and small cell WWAN in an unlicensed, shared communication frequency band. Example communication frequency bands may include unlicensed 5 GHz frequency bands or 3.5 GHz conditional shared communication frequency bands under FCC Part 96. Wi-Fi ISM frequency bands may be subject to sharing include 2.4 GHz, 60 GHz, 900 MHz or similar bands as understood by those of skill in the art. Within local portion of wireless network 250 access points for Wi-Fi or WiGig as well as small cell WWAN connectivity may be available in emerging 5G technology. This may create situations where a plurality of antenna systems are operating on a mobile information handling system 210, 220 or 230 via concurrent communication wireless links on both WLAN and WWAN and which may operate within the same, adjacent, or otherwise interfering communication frequency bands. The antenna may be a transmitting antenna that includes high-band, medium-band, low-band, and unlicensed band transmitting antennas. Alternatively, embodiments may include a single transceiving antennas capable of receiving and transmitting, and/or more than one transceiving antennas. Each of the antennas included in the information handling system 100 in an embodiment may be subject to the FCC regulations on specific absorption rate (SAR). The antenna in the embodiments described herein is an aperture antenna intended for efficient use of space within a metal chassis. Aperture antennas in embodiments of the present disclosure may be a highly effective improvement on wireless antennas employed in previous information handling systems.

The voice and packet core network 280 may contain externally accessible computing resources and connect to a remote data center 286. The voice and packet core network 280 may contain multiple intermediate web servers or other locations with accessible data (not shown). The voice and packet core network 280 may also connect to other wireless networks similar to 240 or 250 and additional mobile information handling systems such as 210, 220, 230 or similar connected to those additional wireless networks. Connection 282 between the wireless network 240 and remote data center 286 or connection to other additional wireless networks may be via Ethernet or another similar connection to the world-wide-web, a WAN, a LAN, another WLAN, or other network structure. Such a connection 282 may be made via a WLAN access point/Ethernet switch to the external network and be a backhaul connection. The access point may be connected to one or more wireless access points in the WLAN before connecting directly to a mobile information handling system or may connect directly to one or more mobile information handling systems 210, 220, and 230. Alternatively, mobile information handling systems 210, 220, and 230 may connect to the external network via base station locations at service providers such as 260 and 270. These service provider locations may be network connected via backhaul connectivity through the voice and packet core network 280.

Remote data centers may include web servers or resources within a cloud environment that operate via the voice and packet core 280 or other wider internet connectivity. For example, remote data centers can include additional information handling systems, data processing servers, network storage devices, local and wide area networks, or other resources as needed or desired. Having such remote capabilities may permit fewer resources to be maintained at the mobile information handling systems 210, 220, and 230 allowing streamlining and efficiency within those devices. Similarly, remote data center permits fewer resources to be maintained in other parts of network 200.

Although 215, 225, and 235 are shown connecting wireless adapters of mobile information handling systems 210, 220, and 230 to wireless networks 240 or 250, a variety of wireless links are contemplated. Wireless communication may link through a wireless access point (Wi-Fi or WiGig), through unlicensed WWAN small cell base stations such as in network 240 or through a service provider tower such as that shown with service provider A 260 or service provider B 270 and in network 250. In other aspects, mobile information handling systems 210, 220, and 230 may communicate intra-device via 248 when one or more of the mobile information handling systems 210, 220, and 230 are set to act as an access point or even potentially an WWAN connection via small cell communication on licensed or unlicensed WWAN connections. For example, one of mobile information handling systems 210, 220, and 230 may serve as a Wi-Fi hotspot in an embodiment. Concurrent wireless links to information handling systems 210, 220, and 230 may be connected via any access points including other mobile information handling systems as illustrated in FIG. 2.

Figure 3A:
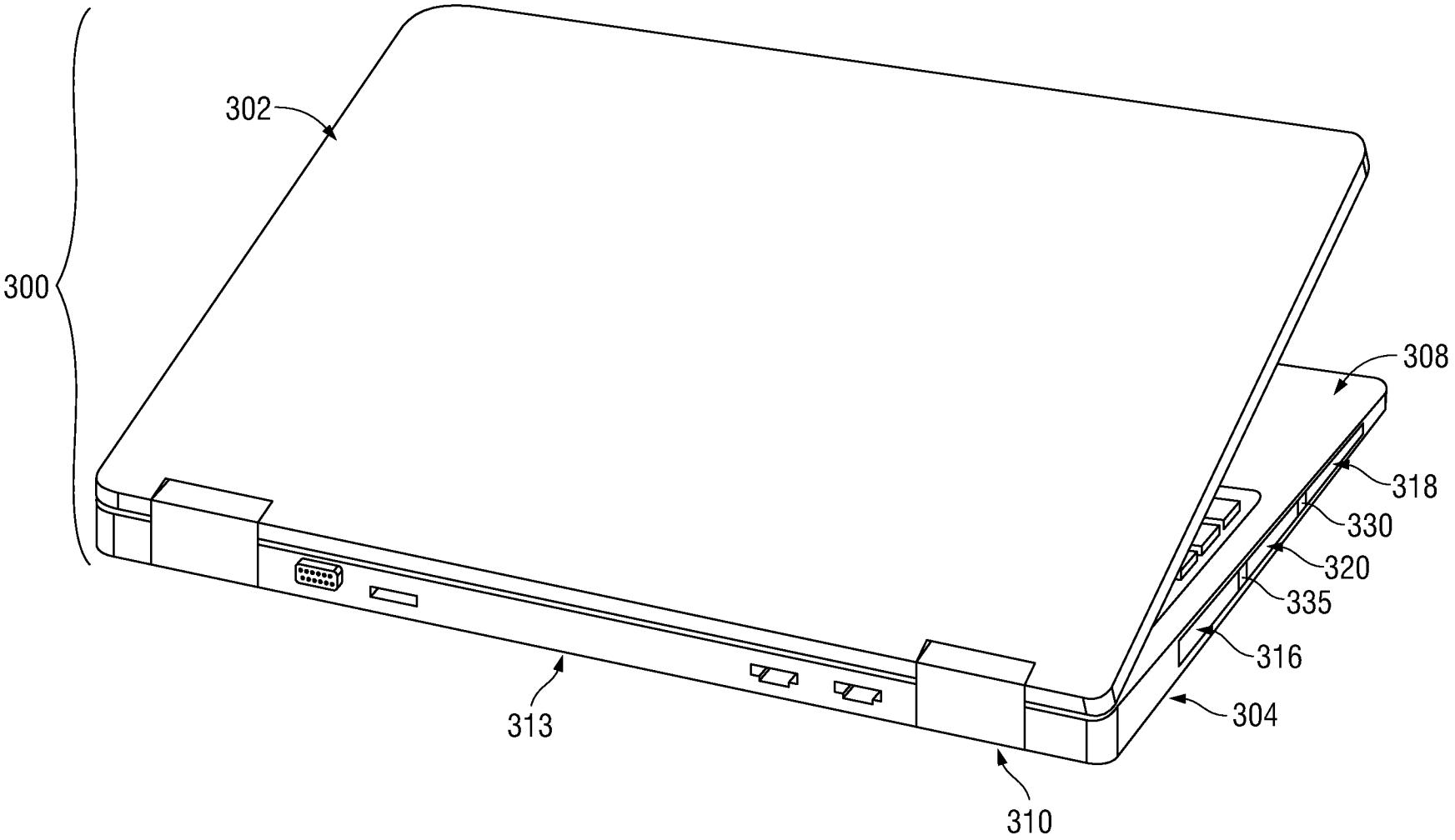
FIG. 3A is a graphical illustration perspective view of a metal chassis placed in a semi-closed configuration according to an embodiment of the present disclosure.

FIG. 3A is a graphical illustration of a metal chassis including a base chassis and lid chassis placed in a semi-closed configuration according to an embodiment of the present disclosure. The graphical illustration of FIG. 3A is a perspective view of the back of an information handling system showing the base chassis and the lid chassis, also referred to as a display chassis. The semi-closed configuration is shown for illustration purposes. It is understood that a closed configuration would have the lid chassis fully closed onto the base chassis. The metal chassis 300 in an embodiment may comprise an outer metal case or shell of an information handling system such as a tablet device, laptop, or other mobile information handling system. As shown in FIG. 3A, the metal chassis 300, in an embodiment, may further include a plurality of chasses or cases. For example, the metal chassis 300 may further include the A-cover 302 functioning to enclose a portion of the information handling system. As another example, the metal chassis 300, in an embodiment, may further include a D-cover 304 functioning to enclose another portion of the information handling system along with a C-cover 308 which may include a transmitting/receiving antenna according to the embodiments described herein. The C-cover 308 may include, for example, a keyboard, a trackpad, or other input/output (I/O) device. As shown in FIG. 3A, when placed in the semi-closed configuration, the A-cover 302 forms a top outer protective shell, or a portion of a lid for the information handling system, while the D-cover 304 forms a bottom outer protective shell, or a portion of a base. As also can be seen in FIG. 3A, when in the fully closed configuration, the A-cover 302 and the D-cover 304 would be substantially parallel to one another.

In some embodiments, both the A-cover 302 and the D-cover 304 may be comprised entirely of metal. In some embodiments, the A-cover 302 and D-cover 304 may include both metallic and plastic components. For example, plastic components that are radio-frequency (RF) transparent may be used to form a portion of the D-cover 304 where an antenna vent 320 is located behind which an RF transmitting antenna may be placed. According to some embodiments of the present disclosure, the antenna vent prevents interference originating from the RF signals from the antenna interfering with the metal of the A or D-covers. However, it may be aesthetically desirable to limit plastic antenna vent components in an A-cover 302 or a D-cover 304. In other embodiments, additional antenna locations may be needed. Thus, by aligning an antenna vent co-located with an audio vent and/or thermal vent defined in the D-cover a hidden antenna system may be realized.

In the embodiment show in FIG. 3A, the D-cover includes is an antenna vent 320 shown to be co-located with one or both of an audio vent 316 and a thermal vent 318. As described in more detail herein, the co-located antenna vent 320 may be formed on a left side, a right side, or a back side 312 of the information handling system such that the antenna vent 320 is co-located with one or both of an audio vent 316 and a thermal vent 318 depending on where the audio vent 316 and thermal vent 318 is formed on the D-cover/C-cover assembly. These different placements of the antenna vent 320 relative to the audio vent 316 and/or thermal vent 318 will be described in more detail in connection with FIGS. 3B, 3C and 4-5.

In an embodiment, the A-cover 302 may be movably connected to a back edge 312 of the D-cover 314 via one or more hinges 310. In any embodiment, the hinge 310 may allow the A-cover 320/B-cover 306 assembly of the display housing to move relative to the C-cover 308/D-cover 304 assembly of the base housing to allow for the orientations described herein.

Figure 3B:
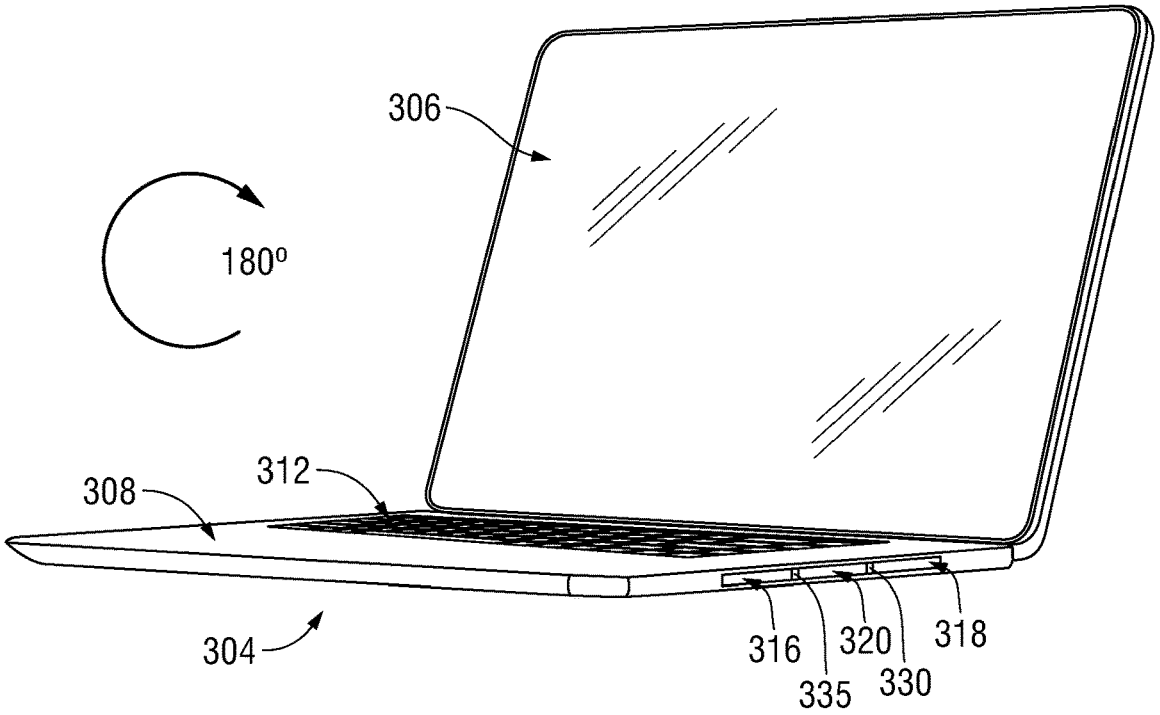
FIG. 3B is a graphical illustration perspective view of a metal chassis placed in an open configuration according to an embodiment of the present disclosure.

FIG. 3B is a graphical illustration of a metal chassis 300 including a base chassis and lid chassis placed in an open configuration according to an embodiment of the present disclosure. The graphical illustration of FIG. 3B is a perspective view of the front of an information handling system showing the base chassis and the lid chassis which is also referred to as a display chassis. The metal chassis 300 in an embodiment may further comprise an outer metal case or shell of an information handling system for housing internal components of the information handling system, such as a video display, a cursor control device, and an alpha numeric input device. As shown in FIG. 3B, the metal chassis 300 may further include the B-cover 306 functioning to enclose the video or digital display device with the A-cover described herein. As another example, the metal chassis 300 may further include the C-cover 308 functioning to enclose a cursor control device and/or a keyboard 112 acting as an alpha numeric input device. The A-cover and the B-cover 306 may be joined together in an embodiment to form a fully enclosed lid chassis, while the C-cover 308 and the D-cover may be joined together to form a fully enclosed base chassis. Taking the closed configuration as a reference position of the lid chassis including the A-cover and the B-cover 306 and the base chassis including the C-cover 308 and the D-cover, the lid chassis including the A-cover and the B-cover 306 may be rotated away from the base chassis including the C-cover 308 and the D-cover to an open configuration. For example, as shown in FIG. 3B, when placed in the open configuration, the lid chassis including the A-cover and the B-cover 306 may be rotated away from the C-cover 308 and placed at an angle less than 180 degrees from the base chassis including the C-cover 308 and the D-cover, such that a user may view the digital display within the B-cover 306 and interact with the cursor control device and/or keyboard 112 within the C-cover 308.

As described herein, the antenna vent 320 may be formed on any surface of the D-cover such as a left side, a right side, and a back side of the D-cover. In an aspect, the D-cover may have curved sides that slope to the bottom of the D-cover and location may be on a left side, right side, or back side or may be on a sloping portion along those sides in various embodiments. In FIG. 3B, the antenna vent 320 is shown to be formed on a right side of the D-cover 304 and co-located with one or both (in FIG. 3B showing both) of the audio vent 316 and thermal vent 318. Although these figures show that the antenna vent 320 is co-located with both the audio vent 316 and thermal vent 318, the present disclosure contemplates that the antenna vent 320 is co-located with the audio vent 316 alone, co-located with the thermal vent 318 alone, or arranged among both the audio vent 316 and thermal vent 318. In any embodiment presented herein, it is understood that the antenna vent 320 may be co-located with one of the audio vent 316 or thermal vent 318 while one of the audio vent 316 and thermal vent 318 is formed on a second side of the D-cover 304. As described in more detail herein, the co-location of the antenna vent 320 with either or both of the audio vent 316 and thermal vent 318 may include at least one partition 335, 330. The partition 335, 330 may define the size of the antenna vent 320 as well as operatively separate the antenna vent 320 from one of the audio vent 316 or thermal vent 318. Further the order of the antenna vent 320, the audio vent 316, and the thermal vent 318 may change in a variety of embodiments as understood by those of skill. Thus, the order of the antenna vent 320, the audio vent 316, and the thermal vent 318 along any side of D-cover 304 may be changed in various embodiments.

Figure 3C:
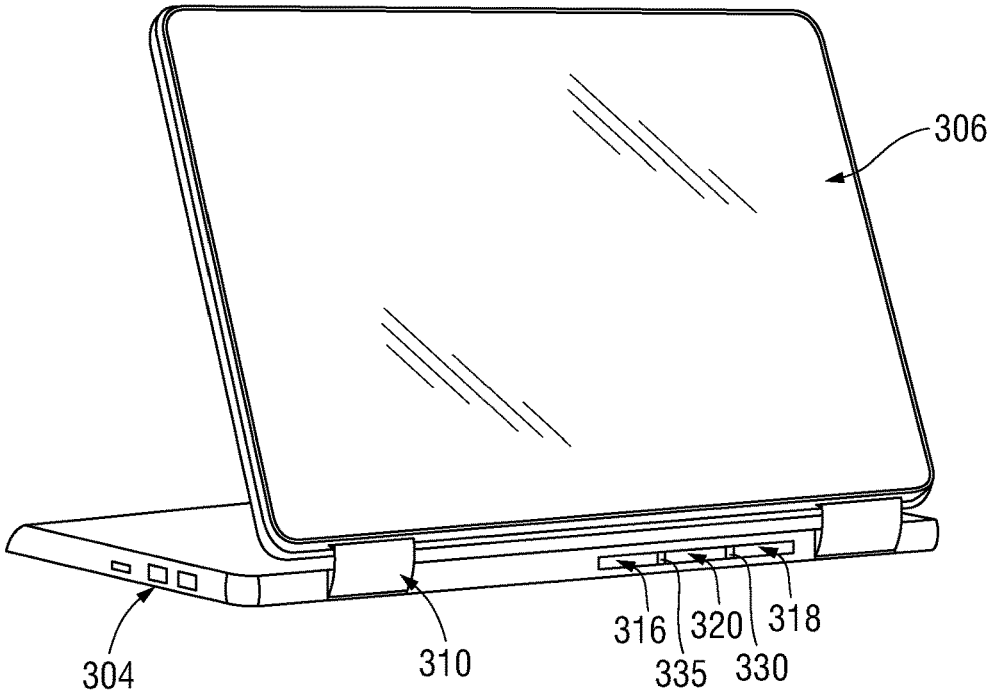
FIG. 3C is a graphical illustration perspective view of a metal chassis placed in an easel configuration according to an embodiment of the present disclosure.

FIG. 3C is a graphical illustration of a metal chassis including a base chassis and lid chassis placed in an easel configuration according to an embodiment of the present disclosure. The graphical illustration of FIG. 3C is a perspective view of the front of an information handling system showing the lid chassis, also referred to as a display chassis forward with respect to the base chassis in the easel configuration. As shown in FIG. 3C, the lid chassis including the A-cover and the B-cover 306 may be joined to the base chassis including the C-cover and the D-cover 304 via one or more hinges 310. The hinge 310 in an embodiment may be capable of placing the lid chassis and base chassis in a plurality of positional configurations with respect to one another, including, but not limited to the open (i.e., shown in FIG. 3B), closed, and tablet, and easel (i.e., FIG. 3C) configurations. Taking the closed configuration as a reference position of the lid chassis including the A-cover and the B-cover 306 and the base chassis including the C-cover and the D-cover 304, the hinge 310 may allow for a 180-degree or greater rotation of the lid chassis to place the lid chassis and base chassis in the easel configuration as shown in FIG. 3C for example. For example, as shown in FIG. 3C, the lid chassis including the A-cover and the B-cover 306 in an embodiment may rotate greater than 180-degrees and up to nearly 360-degrees such that the video display of the B-cover 306 may face toward the user and the keyboard of the C-cover 308 may face away from the user. If the lid chassis including the A-cover and the B-cover 306 are rotated to almost 360-degrees from the closed configuration, the A-cover 302 may abut the D-cover 304 reaching a tablet configuration.

In the embodiment show in FIG. 3C, the D-cover includes an antenna vent 320 shown to be co-located with one or both of an audio vent 316 and a thermal vent 318 on the back side of the D-cover 304. Again, the antenna vent 320 is co-located with one or both of an audio vent 316 and a thermal vent 318 depending on where the audio vent 316 and thermal vent 318 is formed on the D-cover/C-cover assembly. Further the order of the antenna vent 320, the audio vent 316, and the thermal vent 318 along any left, right, or back side of D-cover 304 may be changed in various embodiments. These different placements of the antenna vent 320 relative to the audio vent 316 and/or thermal vent 318 will be described in more detail in connection with the other figures.

Figure 3D:
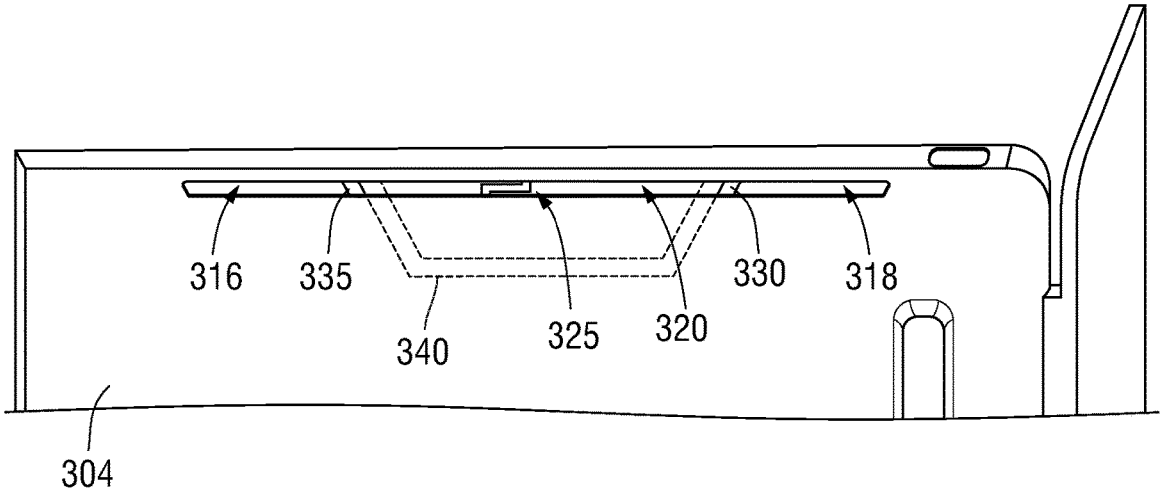
FIG. 3D is a graphical illustration bottom view of an antenna vent and its aperture co-located with an audio vent and thermal vent formed in the D-cover according to an embodiment of the present disclosure.

FIG. 3D is a graphical illustration of an antenna vent aperture 320 co-located with an audio vent 316 and thermal vent 318 formed in the D-cover 304 according to an embodiment of the present disclosure. FIG. 3D shows the aperture of the co-located antenna vent 320 in an embodiment lying directly below the C-cover (not shown) and along a side edge of the D-cover 304 from a bottom view of the D-cover 304. As shown in FIG. 3D, the antenna vent 320 is formed between the audio vent 316 and a thermal vent 318 on a right side of the information handling system.

The audio vent 316 may be any opening that allows for sound waves to escape the D-cover 304 of the information handling system. In an example, a speaker may be placed within the audio vent 316. The speaker may be communicatively coupled to an audio processor of the information handling system. The audio processor (i.e., processor 102 of FIG. 1 in an embodiment) may send electrical signals to the speaker (not shown) that causes the speaker to emit sounds such as music and notification sounds pursuant to operations of the information handling system. In an example, the audio vent 316 may include a screen, plastic resonant structure, or other physical barrier that prevents objects from entering the audio vent. This physical barrier may prevent objects from entering the audio vent 316 while still allowing for the sound waves produced by the speaker to escape from the audio vent 316 and information handling system.

The thermal vent 318 may be any vent that allows heat produced by the information handling system to escape the metal chassis of the D-cover 304. During operation of the information handling system, certain elements (i.e., devices represented in FIG. 1) may produce an amount of heat. Without the thermal vent 318, the heat may not be allowed to escape the chassis and may cause the information handling system to overheat causing damage to the devices therein. In an embodiment, a fan may be placed near the thermal vent 318 to blow heated air from within the chassis and out through the thermal vent 318. In an embodiment, the thermal vent 318 may include a screen or other physical barrier that prevents objects from entering the thermal vent 318. The physical barrier may allow for heated air to pass from inside the chassis and through the thermal vent 318 while also preventing objects from entering the thermal vent 318.

Co-located with the audio vent 316 and the thermal vent 318 may be an antenna vent 320. The co-location of the antenna vent 320 with the thermal vent 318 and audio vent 316 allows for the efficient use of an area of the information handling system to serve as a location where an antenna element 325 may be placed. Again, the industry has gravitated towards lighter, thinner, and more streamlined information handling systems with full metal portions for the outer covers of the display and base housing (e.g. the A-cover and the D-cover). The metal covers may provide strength for the information handling system as well as provide for aesthetic advantages. At the same time, the demands for wireless operation has also increased. This includes addition of many simultaneously operating radiofrequency antennas, addition of more antennas, and utilization of various antenna types. However, the thinner and more streamlined devices have fewer locations and area available for mounting radiofrequency transmitters on these mobile information handling systems. This is especially true where the usable area within the A-cover and B-cover also has disappeared due to the expansion of the display screen. The development of information handling systems with larger, bezel-to-bezel wide display devices pushes out components of the information handling system that otherwise would have been located in the A-cover and B-cover assembly. Because the display screen size has limited the physical placement of the antenna or antennas in the A- and B-cover assembly, another location within the information handling system is to be found to place the antenna or additional antennas without compromising the ability of the antenna to transmit and receive data. Such a location of the present embodiments includes a dedicated vent (i.e., an antenna vent 320) formed alongside one or both of an audio vent 316 or thermal vent 318. In some embodiments, the antenna vent 320 partitioned from the thermal vent 318 and/or audio vent 316 via a grounding wall 340, the location of which is shown via dotted line internal to the D-cover 304. In other embodiments, the antenna vent 320 may share a cavity or aperture with either the audio vent 316, the thermal vent 318, or both. Thus, the present embodiments describe using space within the information handling system that, otherwise, may not have been used for the operation of an antenna element 325.

FIG. 3D also shows a number of partitions 330, 335, in an embodiment, that physically separate the antenna vent 320 from the audio vent 316 and/or thermal vent 318. In an embodiment, a single partition 330 or 335 may be used to separate the antenna vent 320 from one of the either the audio vent 316 or thermal vent 318 depending on the arrangement of the antenna vent 320 relative either the audio vent 316 or thermal vent 318. Thus, although FIG. 3D shows that the antenna vent 320 is positioned between the audio vent 316 and thermal vent 318 this placement is meant merely as an embodiment and placement of these vents 316, 318, 320, from left to right in FIG. 3D, may include audio vent 316, antenna vent 320, then thermal vent 318. In an alternative embodiment, the placement of these vents 316, 318, 320, from left to right in FIG. 3D, may include antenna vent 320, audio vent 316, and then thermal vent 318. In yet another alternative embodiment, the placement of these vents 316, 318, 320, from left to right in FIG. 3D, may include audio vent 316, thermal vent 318, and then antenna vent 320. In still a further alternative embodiment, the placement of these vents 316, 318, 320, from left to right in FIG. 3D, thermal vent 318, audio vent 316, and then antenna vent 320. In still a further alternative embodiment, the placement of these vents 316, 318, 320, from left to right in FIG. 3D, may include thermal vent 318, audio antenna vent 320, and then audio vent 316. In any of these embodiments, however, it is understood that one or two of the partitions 330 or 335 are used to physically separate the antenna vent 320 from the other vents 316, 318. Further, some embodiments may provide for a combination vents between the antenna vent 320, audio vent 316, or thermal vent 318 purposes. Partitions 330, 335 or aperture dimensions may be sized for antenna transmission in such embodiments as described herein.

The partitions 330, 335 may be made of a metal. This metal may be operatively coupled to one or more grounding walls 340 defining an interior surface of the antenna vent 320. The grounding walls may be used by any of the antenna element 325 or other devices within the information handling system to ground an electrical current. FIG. 3D shows that the grounding walls 340, represented by a dotted line to show the location of the grounding walls 340 inside the D-cover 304, include three distinct surfaces that extend into the D-cover of the information handling system. In this embodiment, the grounding walls form a box with one side missing where an aperture is formed by the antenna vent 320 and the partitions 330, 335 operatively coupled to the grounding walls 340. In an embodiment, the shape of the antenna vent 320 defined by the partitions 330, 335, and the size of the space formed by the grounding walls 340 may vary depending on space available in the C-cover and D-cover assembly. In an example, the grounding walls 340 may have one side formed by, for example, a half circle.

In an embodiment, the grounding walls 340 may be used to not only ground devices within the information handling system and specifically the antenna vent 320, but may also be used to insulate the antenna vent 320 from electromagnetic noise originating from outside of the antenna vent 320 and isolate other portions of the chassis from the antenna transmissions. As described herein, the noise may originate from any device also operatively coupled to the information handling system, any device near the information handling device, as well as from operation of the antenna element 325 itself. Because the chassis of the information handling system is metal, operation of the antenna element 325 via emissions of electromagnetic (EM) waves (i.e., RF signals at 2.5 GHz for example) causes those EM waves to resonate with the metal chassis causing noise. In order to avoid this phenomenon, the antenna vent 320 includes the grounding walls 340 in order to insulate the antenna vent 320 and its antenna element 325 from that noise. In addition to the grounding walls 340, the D-cover and/or C-cover of the information handling system may include a shielding wall. The shielding wall may help to create the resonant chamber into which the antenna element 325 is placed. Additionally, the shielding walls may act as a direction reflector to help reflect the EM RF waves within the antenna vent 320 and towards the aperture. Still further, the shielding walls may prevent noise from being created by the oscillation of the metal D-cover resulting from the emissions of the EM RF waves from the antenna element 325.

Figure 5:
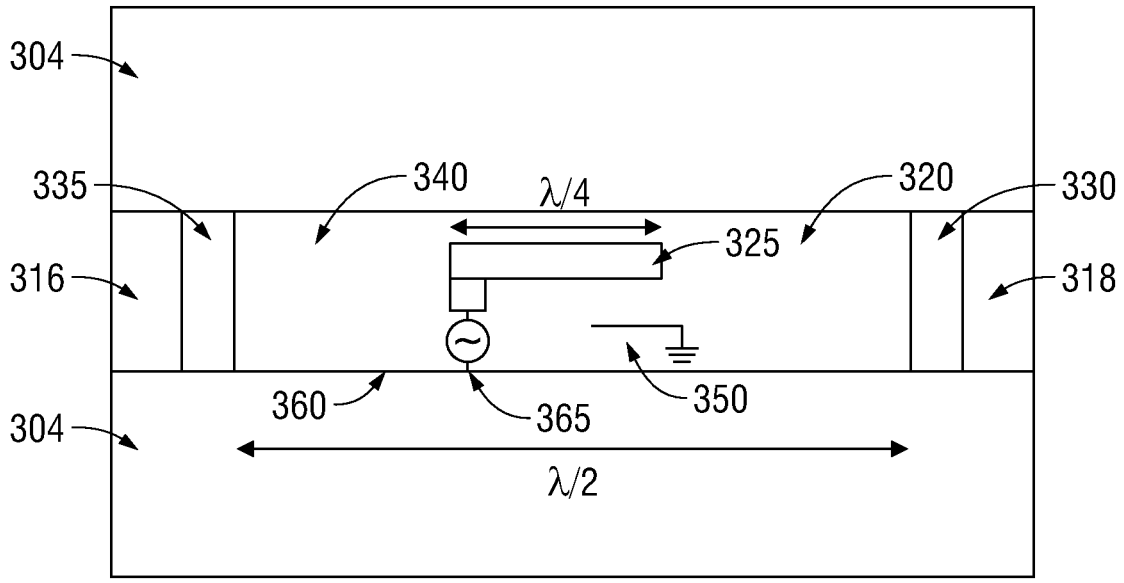
FIG. 5 is a graphical illustration of an antenna vent an its aperture co-located with an audio vent and thermal vent formed in the D-cover according to an embodiment of the present disclosure.

In an embodiment, the antenna vent 320, the partitions 330, 335, the chassis of the information handling system, and/or the grounding walls 340 may form a cavity resonator within the antenna vent 320. A cavity resonator is a hollow closed-in conductor such as a metal cavity, in this embodiment, that contains EM waves (i.e., RF EM waves) reflecting back and forth between the cavity's walls. When the antenna element 325 emits a RF signal at one of the antenna vent's 320 resonant frequencies (i.e., a fundamental frequency at 2.4 GHz or any harmonic frequency of 2.4 GHz), any oppositely moving waves form standing waves within the antenna vent 320. In the example, however, the resonating frequencies may be allowed to exit the cavity resonator via an aperture. Along the length of the-created aperture, the signal transmission may occur thereby sending the EM RF waves out and away from the information handling system. The size and shape of the aperture of the antenna vent 320 may be defined by the placement of the partitions 330, 335 and the grounding walls 340. In an embodiment, a length of the aperture may be dependent on the frequency range to be emitted by the antenna and which frequencies the wireless interface adapter is to be operated at. In an embodiment, the length of the aperture may be between 45 and 55 mm. In an embodiment, the length of the aperture may be 50 mm. During operation, due to the application of the RF radiation from the antenna element 325, current is forced along the length of the aperture causing radiation to be emitted from various points along the length of the aperture at the target frequency (e.g., ~5 GHz or harmonics thereof). Any target frequency, however, is emitted along the length of the aperture when the dimension of the aperture is formed correctly (e.g., ~2.4 GHz). In any example, the length of the aperture (as shown in FIG. 5) is ½ of the wavelength of the target frequency.

In an example, the antenna element 325 may be a monopole antenna. The monopole antenna element 325 may comprise a straight conductor that acts as an open resonator oscillating with standing waves of voltage and current along its length. The length of the monopole antenna element 325 may be set to operate based on the wavelength of the EM waves used during transmission and/or reception of the propagating signals. In an embodiment, the monopole antenna element 325 may include a metal conducting strip excited by an RF signal source such as the wireless adapter described herein. In an embodiment, the length of the conductor is designed to be a quarter of the wavelength relative to a fundamental operating EM RF of the aperture. In this embodiment, the monopole antenna element 325 is suspended within the cavity at a certain distance from the aperture to effectively couple the monopole currents induced by the RF signal emitted. The induced currents are coupled onto the aperture capacitively over the air to excite the fundamental resonant frequency of the aperture. In an embodiment, the conductor carrying the RF signal from the source could be a transmission line or a shielded RF cable with a characteristic impedance of 50 ohms (for example, same as a current source). To ensure effective impedance transfer in an embodiment, a shielded RF cable may be attached to one of the grounding walls of the resonant chamber to short any leakage currents present on the surface of the cable and to prevent the cable from re-radiating inside the chamber. This may be done in some embodiments to avoid the creation of a cavity mode local to the cable and the wall that could contain some or all of the EM energy to prevent the EM energy from being re-radiated. Thus, in such embodiments, the transmission element may avoid a local cavity mode within the cavity that could impair the wireless performance. In an embodiment, the monopole antenna element 325 may be sized to transmit and receive EM RF frequencies at or around 5 GHz. In an embodiment, the monopole antenna element 325 may be sized to transmit and receive EM RF frequencies at or around any harmonic frequencies at or around 5 GHz.

In an embodiment, the monopole antenna element 325 may include a conducting plane. In this embodiment, the conducting plane may reflect the EM waves emitted by the monopole antenna element 325 so as to increase the gain of the antenna element 325. These EM RF waves emitted by the monopole antenna element 325 within the antenna vent 320 may be conducted towards the aperture and emitted from the information handling system as described herein. Because, in this embodiment, the antenna element 325 is a monopole antenna, the length of the monopole antenna may be ¼ of the wavelength at which the antenna element 325 is to operate. Consequently, the length of the antenna element 325 and the size of the aperture of the antenna vent 320 may be dependent on the wavelengths used by the information handling system as well as any governmental or industry standards under which the information handling system is to be operated. In an embodiment, the monopole antenna element 325 may be sized to transmit and receive EM RF frequencies at or around 5 GHz. In an embodiment, the monopole antenna element 325 may be sized to transmit and receive EM RF frequencies at or around any harmonic frequencies at or around 5 GHz.

In an embodiment, the antenna vent 320 may include a parasitic coupling element or other type of coupled device used to create additional higher frequency resonant modes as well as alter the pattern of the EM RF waves emitted by the antenna element 325. The parasitic coupling element may be grounded to one of the grounding walls 340. In an embodiment, the parasitic coupling element may be used to steer the EM RF signal out of the antenna vent 320 or towards the aperture of the antenna vent 320 as well as create a second or additional RF EM bands to be emitted by the antenna system. In this embodiment, the parasitic coupling element may be an inert element that is not activated by an electrical source in order to cause the steering of the EM RF signal or the creation of the second or additional RF EM band. In an embodiment, the parasitic coupling element may be operatively coupled to a variable impedance termination. In this embodiment, using a parasitic coupling element with a variable impedance termination and which may be triggered by a switch, the information handling system may control the directionality of the transmission signal to thereby cause a shift of transmission pattern. The antenna adaptation controller 134 may control this aperture tuning for the antenna ports for the antenna to alter RF transmission pattern potentially improve RSSI, SNR, MCS or other performance factors.

Figure 4:
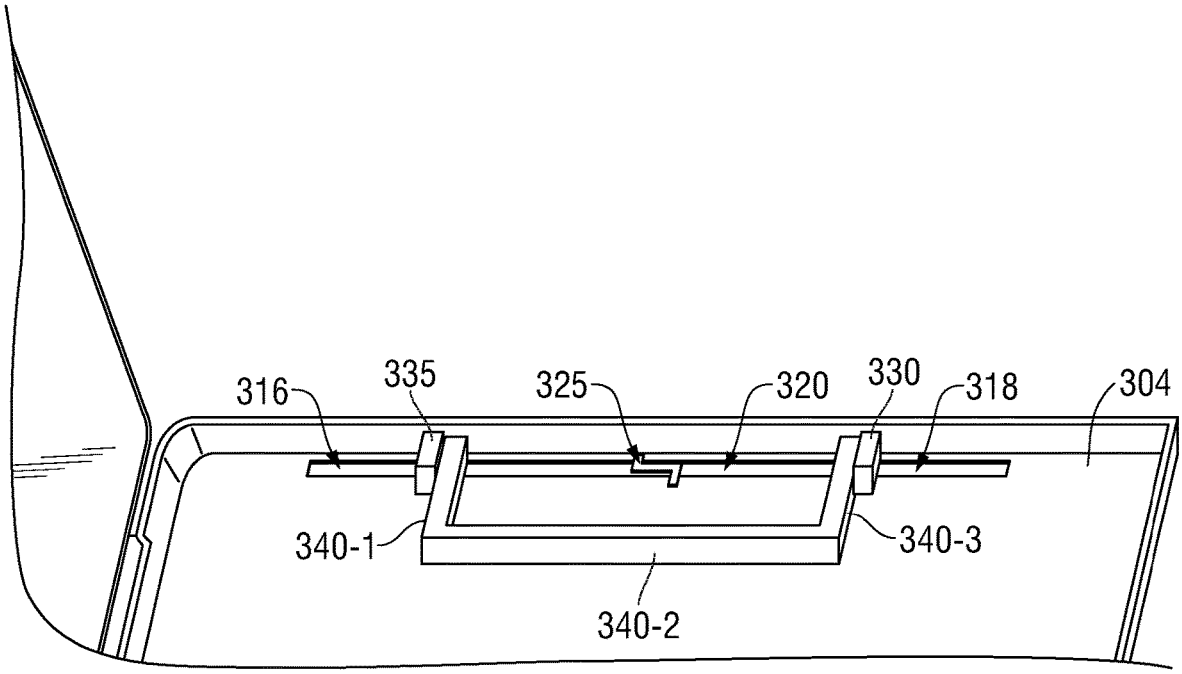
FIG. 4 is a graphical illustration top view of an antenna vent and its aperture co-located with an audio vent and thermal vent formed internal to the D-cover according to an embodiment of the present disclosure.

FIG. 4 is a graphical illustration of an antenna vent 320 and its aperture co-located with an audio vent 316 and thermal vent 318 according to an embodiment. FIG. 4 is a top view of the inside of the D-cover 304 without the C-cover according to an embodiment of the present disclosure. In the shown embodiment of FIG. 4, antenna element 325, antenna vent 320, and related structures, are viewed without a C-cover and other internal information handling system structures for illustrative purposes. As described herein, the antenna vent 320 may include grounding walls 340-1, 340-2, 340-3 placed within the antenna vent 320. The number of grounding walls 340-1, 340-2, 340-3 may include three grounding walls 340-1, 340-2, 340-3: a left grounding wall 340-1, a rear grounding wall 340-2, and a right grounding wall 340-3. The left grounding wall 340-1 may be operatively coupled to the rear grounding wall 340-2 and one of the partitions 335 and specifically, as shown in FIG. 4, a left partition 335 placed between the antenna vent 320 and the audio vent 316. In other embodiments, the end of a left grounding wall 340-1 may serve as the left partition 335. The right grounding wall 340-3 may be operatively coupled to the rear grounding wall 340-2 and one of the partitions 330, 335 and specifically, as shown in FIG. 4, a right partition 330 placed between the antenna vent 320 and the thermal vent 318. In other embodiments, the end of the right grounding wall 340-3 may server as the right partition 330. The embodiments herein, however, contemplate that one of the partitions 330, 335 may not be used due to the placement of the antenna vent 320 relative to the thermal vent 318 and audio vent 316. In these examples, the antenna vent 320 may share a common wall with either of the audio vent 316 and thermal vent 318 but not exclusively with both of the thermal vent 318 and audio vent 316.

The aperture of the antenna vent 320 is the edge around the antenna vent 320 with the antenna element 325 located internal to the aperture. In an embodiment, the height of the grounding walls 340-1, 340-2, 340-3 may be equal to the height of the aperture of the antenna vent 320. In an embodiment, the length of the rear grounding wall 340-2 may be equal to the length of the aperture of the antenna vent 320. In an embodiment, the dimensions of any of the grounding walls 340-1, 340-2, 340-3 may be independent of the height and length of the aperture of the antenna vent 320. As described herein, the grounding walls 340-1, 340-2, 340-3 as well as any other shielding or grounding walls may be used to form a resonant chamber into which the antenna element 325 may be placed. This allows the antenna element 325 to create a resonant frequency within the resonant chamber and direct that EM RF emission towards the aperture of the antenna vent 320 for transmission. Additionally, the antenna element 325 may use the resonant chamber created by the grounding walls 340-1, 340-2, 340-3 to receive or transmit wireless signals.

The antenna vent 320 described herein may be co-located with one or both of the audio vent 316 and thermal vent 318 so as to create a location where the antenna element 325 may be placed within the information handling system. This is because the space within the A-cover and B-cover assembly may be rendered unavailable or less available for additional antennas due to the expansion of the screen space and other devices placed within that assembly. Additionally, because the audio vent 316 and thermal vent 318 may include a specific open space within the chassis of the information handling system, the open space may be utilized by the operation of the antenna element 325. The antenna vent 320 may be partitioned from the audio vent 316 and thermal vent 318 using the grounding walls 340-1, 340-2, 340-3 and partitions 330, 335 so as to isolate the antenna element 325 in the antenna vent 320 and limit potential resonant oscillation of other metal chassis parts of the information handling system. The design of the antenna vent 320 may include a specific dimensioned aperture of the antenna vent 320 that is sized to allow for the emission and reception of a target frequency of EM RF waves such as 2.4 GHz or 5 GHz. The antenna vent 320, along with the antenna element 325, may include a parasitic coupling element that helps to steer the EM RF waves emitted by the antenna element 325 as well as creating additional higher frequency resonant modes to bond to harmonic frequencies of the aperture to create a global 5 GHz band coverage and be excited using a 5 GHz monopole antenna. Additionally, because of the varying amounts of sizes of the audio vent 316 and thermal vent 318, the size of the aperture of the antenna vent 320 may be manufactured to fit specific EM RF frequency transmissions and receptions. Thus, the co-location of the antenna vent 320 with the audio vent 316 and/or thermal vent 318 may allow for the increase in size of the screen on the information handling system while also implementing space within the information handling system that would otherwise be us unused and open. This increases the functionality of the information handling system while also increasing the usability and portability of the information handling system.

FIG. 5 is a graphical illustration of an antenna vent an its aperture co-located with an audio vent and thermal vent formed in the D-cover according to an embodiment of the present disclosure. FIG. 5 shows an interior view of the antenna vent 320 with additional details related to the antenna element 325. In an embodiment, the antenna element 325 may be a monopole antenna element 325 that is provided a voltage at a certain current via a voltage source 365. In an embodiment, the length of the antenna element 325 may be $1/4^{th}$ the length of the wavelength at which the antenna element 325 is to operate. As described herein, the aperture 360 is the outside edge of antenna vent 320 and may have a length that is half the wavelength at which the antenna element 325 is to operate.

The antenna vent 320 may also house a parasitic coupling element 350. The parasitic coupling element 350 may be grounded to one of the grounding walls 340 or some other grounding source. In an embodiment, the parasitic coupling element 350 may be used to create a higher frequency resonant mode that bonds with the harmonic frequency of the aperture creating a global 5 GHz coverage. Further, the antenna vent 320 with antenna element 325 and parasitic coupling element 350 within the cavity formed of the grounding walls may be used to steer the EM RF signal out of the antenna vent 320 or towards the aperture of the antenna vent 320.

In an embodiment, the parasitic coupling element 350 may create higher order resonant modes to increase the global band coverage of a 5 GHz-operated antenna element for example. This enables 5 GHz operation in a variety of locations or jurisdictions that may operate 5 GHz frequency bands at differing frequency ranges such as across different countries. Thus, the system of the present embodiment may be utilized in information handling system designs for multiple different markets as well in some embodiments. In this embodiment, three resonant modes of the 5 GHz antenna element may be realized through the use of the parasitic coupling element 350 which may include several modes including a monopole antenna element excited to operate at 5 GHz, even harmonics of a primary 2.4 GHz-sized aperture that fall into 5 GHz, or with the parasitic coupling element 350 resonating at a higher end of a 5 GHz frequency. These three modes are designed to operate such that the frequencies bond constructively to create the wide band 5G coverage while limiting frequency overlapping.

As described herein, the chassis of the information handling system may be made of metal. During operation of the antenna element 325, however, the EM RF waves emitted by the antenna element 325 may cause these metal chassis parts to oscillate, emitting RF noise in the process. This may interfere with the operation of the antenna element 325 causing destructive interference during transmission or reception of data by the antenna element 325. Additionally, other portions of the information handling system may have noise generating components that may interfere with transmission or reception of data by the antenna element 325. As described herein, the antenna vent 320, therefore, includes a number of grounding walls 340 such as the rear grounding wall 340-2 shown in FIG. 5.

Figure 6:
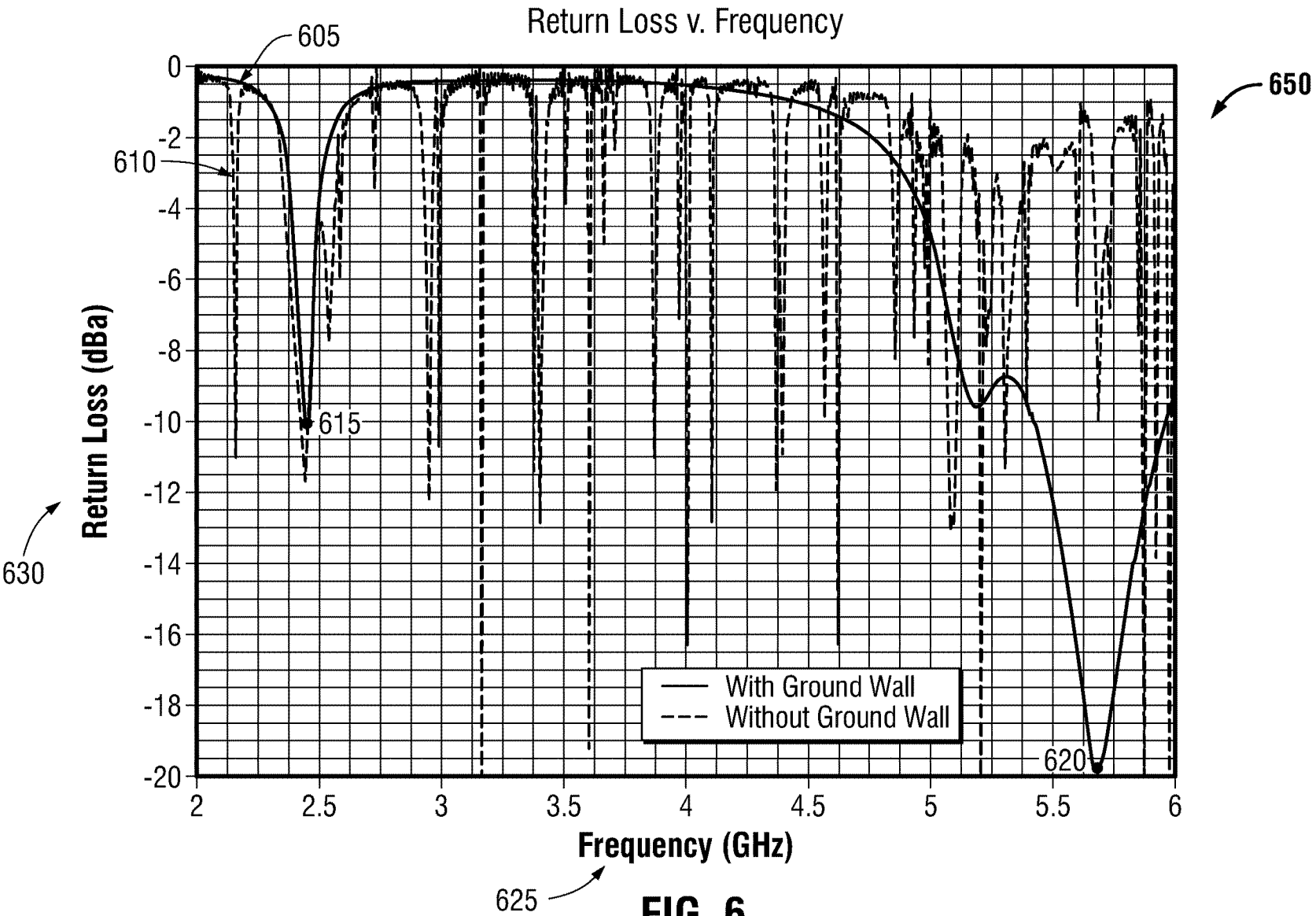
FIG. 6 a graph showing values of return loss (in dBa) versus frequency of a radiofrequency (RF) wave according to an embodiment of the present disclosure.

FIG. 6 is a graph 600 showing values of return loss (in dBa) 630 versus frequency 625 of a RF wave according to an embodiment of the present disclosure. Graph 600 shows the return loss versus a frequency and may be measured using a vector network analyzer (VNA) that plots transmission power loss values relative to frequency.

The graph 600 shows two lines 610 and 605 showing spurious resonant modes created outside the bands of operation which will impact the transceiver performance and act as a noise source polluting other digital electronics inside the information handling system. If these spurious resonant modes are not contained, a difference in return loss (i.e., loss of power in a signal returned or reflected after transmission by the antenna element 325) experienced when the grounding walls 340-1, 340-2, 340-3 are and are not implemented is also shown. A decrease in return loss, such as the more negative decibel (dBa) values for line 610, corresponds to a greater amount of power in the form of EM RF waves being delivered to an antenna by the antenna element 325 within the antenna vent 320 or less power returned or reflected. In the example, where the grounding walls 340-1, 340-2, 340-3 are not present within the antenna vent 320, the multitude of resonances are produced outside the bands of operation ranging from 2 GHz to 6 GHz, shown with varying power transfer ability that could produce unwanted RF noise interfering with digital circuits within the information handling system. These varying power transfer abilities shown at the varying frequencies are related to the EM RF waves interacting with elements of the information handling system such as the metal chassis. In these examples, the antenna element 325 is not isolated and any EM RF emissions may cause noise resulting from creating oscillations in the metal of the chassis.

In contrast, the graph 600 of FIG. 6 shows a second line 605 (solid line) having two significant decreases in return loss at point 615 generally at 2.4 GHz and a harmonic frequency point 620 at around 5.8 GHz. At these points 615, 620, the grounding walls 340-1, 340-2, 340-3 have created a resonant chamber such that any noise created exterior to the antenna vent 320 does not interfere with the transmission and reception of EM RF waves at the antenna element 325. The frequency return loss points 615 and 620 correspond, for example, to some WiFi frequency bands and show targeted and improved return loss levels corresponding to better delivered power levels from the antenna system.

Figure 7:
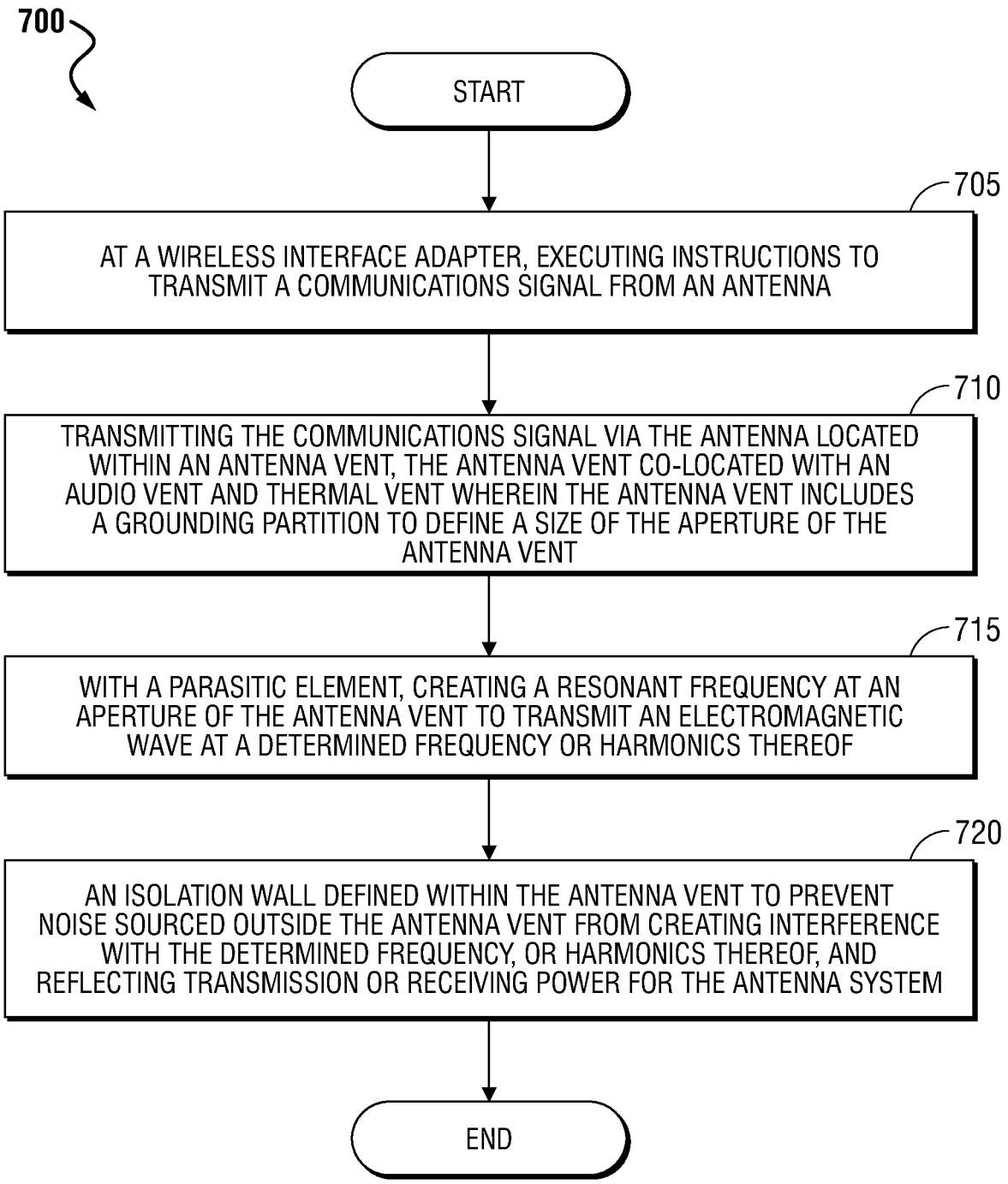
FIG. 7 is a flow diagram illustrating a method for operating an information handling system having an antenna vent co-located with an audio vent and thermal vent according to an embodiment of the present disclosure.

FIG. 7 is a flow diagram illustrating a method 700 for operating an information handling system having an antenna vent co-located with an audio vent and thermal vent according to an embodiment of the present disclosure. The method 700 may include, at block 705, executing instructions to transmit a communications signal from an antenna at a wireless interface adapter. In an embodiment, these instructions may be executed by the processor of the information handling system. In an embodiment, these instructions may be executed by an antenna adaption controller associated with the wireless interface adapter. In an embodiment, the execution of these instructions may be completed partially by the processor of the information handling system and antenna adaption controller. In either example, the execution of the instructions causes a voltage at a certain current or currents to be applied to an antenna such as a monopole antenna placed within an antenna vent. As described herein, the signals sent to the antenna may causes electromagnetic waves in any range of a RF on the EM spectrum.

At block 710, the communications signal may be transmitted by the antenna. As described herein, the antenna may be placed within an antenna vent co-located with an audio vent and/or a thermal vent. The specific arrangement of the antenna vent relative to the audio vent and thermal vent may vary with the antenna vent being located next to the audio vent alone, the thermal vent alone, or both the audio vent and thermal vent as shown in FIGS. 3D and 4.

In any embodiment, the antenna vent may also include a grounding partition that defines the aperture size of the antenna vent. In some embodiments described herein, the antenna vent includes a number of grounding walls operatively coupled to the grounding partitions. The grounding walls may form the antenna vent into a resonant chamber that propagates the EM RF waves towards an aperture of the antenna vent 320 in these embodiments. As described herein, the sizing of the resonant chamber, grounding walls, grounding partitions, and the aperture may depend on the frequencies to be emitted by the antenna. In an example, the length of the aperture is about 50 mm so as to propagate a frequency of about a 5 GHz (or 2.4 GHz) signal or harmonics thereof.

At block 715, the method 700 may continue with creating a resonant frequency at the aperture of the antenna vent so as to transmit an EM wave at another determined frequency or harmonics thereof to steer the EM RF signal out of the antenna vent or towards the aperture of the antenna vent from within the cavity formed with the isolation walls. In an embodiment, a parasitic coupling element may be used to create a higher frequency resonant mode that bonds with the harmonic frequency of the aperture creating a global 5 GHz coverage. In an embodiment, three resonant modes of the 5 GHz antenna element may be realized through the use of the parasitic coupling element with the disclosed antenna vent aperture antenna system. A first mode may include a monopole antenna element excited to operate at 5 GHz. A second mode may operate at even harmonics of a 2.4 GHz-sized aperture that fall into 5 GHz ranges. A third mode may include the parasitic coupling element resonating at a higher end of a 5 GHz frequency. These three modes are designed to operate such that the frequencies bond constructively to create the wide band 5G coverage while limiting frequency overlapping.

At block 720 an isolation wall, during emission of the EM RF emissions may prevent noise sourced outside of the antenna vent from creating interference with the determined frequency or harmonics thereof. The isolation or grounding wall may be formed within the antenna vent and may define the width, height, and length of the antenna vent. The isolation walls may also be used, at block 720, to reflect transmission or reception power for the antenna systems described herein. Specifically, the isolation walls may help to form a resonant chamber within the antenna vent so as to propagate EM RF waves of a target (or near target) frequency. Thus, during operation at block 720, the isolation walls may facilitate in the transmission and reception of those target frequencies or harmonics thereof while rejecting other frequencies. This allows for the antenna to transmit EM RF waves at a frequency of, for example, 2.4 GHz or 5 GHz per some industry standard wireless communication protocols or per variation for international wireless standards for WiFi or other protocols.

The blocks of flow diagram of FIG. 7 discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An information handling system to wirelessly transmit and receive data at an antenna comprising:

a display housing chassis;

a base housing metal chassis containing components of the information handling system the base metal housing metal chassis including a vent aperture having a thermal vent, an audio vent, and an antenna vent, the antenna vent being co-located with the thermal vent and the audio vent of the vent aperture in the base housing metal chassis; and the co-located antenna vent including:

partitions defining a width of a portion of the vent aperture formed at the co-located antenna vent to accommodate a target frequency range;

a monopole antenna system formed within the co-located antenna vent including a parasitic coupling element; and a grounding wall defined along an edge of the co-located antenna vent.

2. The information handling system of claim 1, wherein the antenna vent is formed between the audio vent and the thermal vent with the partitions operatively coupled to the antenna vent to separate the antenna vent from the audio vent and thermal vent.

3. The information handling system of claim 1, wherein the antenna vent is formed alongside one of the audio vent or thermal vent with the partition operatively coupled to the antenna vent to separate the antenna vent from the audio vent or thermal vent.

4. The information handling system of claim 1, wherein the monopole antenna is operated at a resonance of 5 GHz.

5. The information handling system of claim 1, wherein the parasitic coupling element is grounded to a wall of the co-located antenna vent to steer electromagnetic radiation emitted by the monopole antenna.

6. The information handling system of claim 1, wherein the grounding wall formed within the co-located antenna vent forms a resonating cavity that allows electromagnetic waves of a particular frequency to pass while preventing the propagation of other frequencies based on the size of the resonating cavity.

7. The information handling system of claim 1, comprising a wireless interface adapter including an antenna adaption controller to select power adjustments and adjustments to the antenna to modify antenna radiation patterns and operating parameters of a parasitic coupling element operatively coupled to the antenna.

8. The information handling system of claim 1, wherein the partitions defining the width of the aperture formed at the co-located antenna vent to accommodate the target frequency is equal to half the wavelength of the target frequency.

9. A metallic base housing forming a bottom cover for an information handling system comprising:

the metallic base housing operatively coupled to components of the information handling system, the metallic base housing with a vent aperture formed therein including:

an audio vent;

a thermal vent; and an antenna vent co-located with the audio and thermal vents in the metallic base housing, the antenna vent including a portion of the vent aperture to propagate a radio frequency (RF) signal therefrom;

an antenna placed within the antenna vent to emit the RF signal; and a parasitic coupling element operatively coupled to the antenna to modify the RF signal emitted by the portion of the vent aperture that is the antenna vent.

10. The metallic base housing of claim 9, wherein the antenna vent is formed between the audio vent and the thermal vent with a partition operatively coupled to the antenna vent to separate the antenna vent from the audio vent and thermal vent.

11. The metallic base housing of claim 9, wherein the antenna vent is formed alongside one of the audio vent or thermal vent with a partition operatively coupled to the antenna vent to separate the antenna vent from the audio vent or thermal vent.

12. The metallic base housing D cover of claim 9, comprising a wireless interface adapter including an antenna adaption controller to select power adjustments and adjustments to the antenna to modify the RF signal patterns and operating parameters of the parasitic coupling element operatively coupled to the antenna.

13. The metallic base housing of claim 9, comprising at least one partition defining a width of the vent aperture formed at the co-located antenna vent to accommodate a target frequency the at least one partition defining a width of the aperture to accommodate a target frequency that is equal to half the wavelength of the target frequency.

14. The metallic base housing of claim 9, comprising one or more grounding walls formed within the antenna vent to insulate the antenna from electromagnetic radiation interference originating from sources exterior to the antenna vent.

15. An information handling system to transmit a communication signal comprising:

a base housing metal chassis containing components of the information handling system and the base housing metal chasses having a vent aperture including a thermal vent, an audio vent, and an antenna vent, the antenna vent being co-located with the thermal vent and the audio vent in vent aperture of the base housing metal chassis; and the co-located antenna vent including:

partitions defining a width of a portion of the vent aperture formed at the co-located antenna vent to accommodate a target frequency;

a monopole antenna formed within the co-located antenna vent including a parasitic coupling element; and a grounding wall forming a cavity for the monopole antenna inside the co-located antenna vent, wherein the portion of the vent aperture for the antenna vent is bounded by metallic partitions forming part of a three-sided wall that is the grounding wall.

16. The information handling system of claim 15, wherein the antenna vent is formed between the audio vent and the thermal vent with the metallic partitions operatively coupled to the antenna vent to separate the antenna vent from the audio vent and thermal vent.

17. The information handling system of claim 15, wherein the antenna vent is formed alongside one of the audio vent or thermal vent with the metallic partitions operatively coupled to the antenna vent to separate the antenna vent from the audio vent or thermal vent.

18. The information handling system of claim 15, wherein the parasitic coupling element is grounded to the grounding wall of the co-located antenna vent to steer electromagnetic radiation emitted by the antenna.

19. The information handling system of claim 15, wherein the grounding wall formed within the co-located antenna vent prevent resonance from propagating into the base chassis of the information handling system.

20. The information handling system of claim 15, wherein the metallic partitions defining the width of the aperture formed at the co-located antenna vent to accommodate the target frequency is equal to half the wavelength of the target frequency.

* * * * *